US012317978B1

(12) United States Patent
Peng

(10) Patent No.: US 12,317,978 B1
(45) Date of Patent: Jun. 3, 2025

(54) CARD HOLDER

(71) Applicant: Qiyong Peng, Yichun (CN)

(72) Inventor: Qiyong Peng, Yichun (CN)

( * ) Notice: Subject to any disclaimer, the term of this patent is extended or adjusted under 35 U.S.C. 154(b) by 0 days.

(21) Appl. No.: 18/791,293

(22) Filed: Jul. 31, 2024

(51) Int. Cl.
*A45C 11/18* (2006.01)

(52) U.S. Cl.
CPC ..... *A45C 11/182* (2013.01)

(58) Field of Classification Search
CPC ..... A45C 11/182; A45C 13/30
USPC ..... 150/147
See application file for complete search history.

(56) References Cited

U.S. PATENT DOCUMENTS 9,314,074 B2 * 4/2016 Johnson ..... A45C 1/06
D934,560 S * 11/2021 Tran ..... D3/247
11,969,066 B1 * 4/2024 Zeng ..... A45C 1/06
12,029,294 B1 * 7/2024 Zeng ..... A45C 11/182
2002/0157745 A1 * 10/2002 Stodghill ..... A45C 1/06 150/145
2018/0064228 A1 * 3/2018 Xiao ..... A45D 20/50
2019/0380458 A1 * 12/2019 Muldowney, Jr. ... A45C 11/182
2022/0087389 A1 * 3/2022 Wulff ..... H01F 7/02
2022/0225742 A1 * 7/2022 Tran ..... A45C 11/182
2023/0136219 A1 * 5/2023 Zhang ..... A45C 13/185 150/131
2023/0284758 A1 * 9/2023 Espartero ..... A45C 11/321
2024/0260728 A1 * 8/2024 Shan ..... A45C 11/182

* cited by examiner

*Primary Examiner* — Sue A Weaver

(57) ABSTRACT

A card holder includes a main body, a flexible protective cover and a first cover plate. The main body has a first containing cavity and a first containing opening. The first containing opening communicates with the first containing cavity. The first containing cavity is configured for holding cards. The flexible protective cover is arranged between the main body and the first cover plate. The first cover plate is connected to the main body. The first cover plate compresses the flexible protective cover onto the main body. Thus, a user is able to store the card into the first containing cavity of the main body through the first containing opening to achieve the storage and management of the cards. Since the flexible protective cover is arranged, it is able to cover the main body, making the main body more attractive in appearance and more comfortable in hand feel.

15 Claims, 21 Drawing Sheets

CARD HOLDER

TECHNICAL FIELD

The present disclosure relates to the field of card packages, in particular to a card holder.

BACKGROUND

Modern life involves dealing with cards more or less, such as a variety of IC cards, bank cards, supermarket cards, shopping cards, membership cards and so on. Such a large number of cards are difficult to store, prone to disarray and loss, and often give rise to many needless troubles. Hence, there is an urgent market demand for a card holder to facilitate the management of such a large number of cards.

SUMMARY

In order to overcome the shortcomings of the prior art, the present disclosure provides a card holder.

The card holder includes a main body including a first containing cavity and a first containing opening, the first containing opening being communicated the first containing cavity, the first containing cavity is configured for holding the cards;

a flexible protective cover;

a first cover plate connected to the main body, wherein the flexible protective cover is arranged between the main body and the first cover plate, the first cover plate is connected to the main body, and the first cover plate compresses the flexible protective cover onto the main body.

As an improvement of the present disclosure, the flexible protective cover includes a first part and a second part, the first part and the second part are rotatably connected, the first part is arranged between main body and the first cover plate, and the first cover plate compresses the first part onto the main body.

As an improvement of the present disclosure, main body includes a upper sidewall and a lower sidewall, the upper sidewall includes a first outer surface and a first inner surface, the lower sidewall includes a second outer surface and a second inner surface, the first containing cavity is formed between first inner surface and the second inner surface, the first part is arranged between the second outer surface and the first cover plate, the first cover plate is connected with the second outer surface, and the first cover plate compresses the first part onto the second outer surface.

As an improvement of the present disclosure, the second part is able to rotate to cover the first outer surface of the upper sidewall.

As an improvement of the present disclosure, when the second part rotates to cover the first outer surface of the upper sidewall, the second part is connected with the upper sidewall by magnetic force.

As an improvement of the present disclosure, the second part is provided with a first magnetic attraction part, the upper sidewall is a metal upper sidewall, when the second part rotates to cover the first outer surface of the upper sidewall, the second part is adsorbed onto the upper sidewall by the first magnetic attraction part.

As an improvement of the present disclosure, the flexible protective cover is further provided a second containing cavity and a second containing opening, the second containing opening is connected to the second containing cavity, and the second containing cavity is configured for holding paper currency.

As an improvement of the present disclosure, the flexible protective cover includes an inner layer and an outer layer, the inner layer is arranged between the first cover plate and the main body, the first cover plate compresses the inner layer onto main body; the inner layer is connected with the outer layer, and the second containing cavity is formed between the inner layer and the outer layer.

As an improvement of the present disclosure, the inner layer is provided a first bottom edge, a first top edge opposite to the first bottom edge, a first left edge connecting the first bottom edge to the first top edge and a first right edge; the outer layer is provided a second bottom edge, a second top edge opposite to the second bottom edge, a second left edge connecting the second bottom edge to the second top edge and a second right edge; the first bottom edge is connected with the second top edge, the first left edge is connected with the second left edge, the first right edge is connected with the second right edge, such that the inner layer is connected with the outer layer, the second containing cavity is formed between the inner layer and the outer layer, and the second containing opening is arranged between the first top edge and the second top edge.

As an improvement of the present disclosure, a main part of the flexible protective cover further includes a third part, the second part is rotatably connected with one side of the first part, the third part is rotatably connected with the other side of the first part, the third part is able to be rotated to cover the first part, and the second part is able to be rotated to cover the third part.

As an improvement of the present disclosure, the third part is connected with the second part by magnetic force; the second part is provided with the first magnetic attraction part, the third part is provided with a first magnetic attraction matching part, when the third part rotates to cover the first part and the second part rotates to cover the third part, the first magnetic attraction part is connected with the first magnetic attraction matching part by magnetic force.

As an improvement of the present disclosure, the flexible protective cover is further provided with the second containing cavity and the second containing opening, the second containing opening is connected with the second containing cavity, the second containing cavity is configured for holding paper currency, the second containing cavity extends between the first part, the second part and the third part, and the second containing opening extends between the first part, the second part and the third part.

As an improvement of the present disclosure, the card holder further includes a first sheet body, a second sheet body, a third sheet body and a fourth sheet body, the flexible protective cover includes the inner layer and the outer layer, the inner layer is connected with the outer layer, the first sheet body is arranged on the second part and connected with an outer side of the outer layer, a third containing cavity is formed between the first sheet body and the outer side of the outer layer, a third containing opening is arranged on an upper side of the third containing cavity; the second sheet body is arranged on the second part and connected with an inner side of the outer layer, a fourth containing cavity is formed between the second sheet body and the inner side of the outer layer, a fourth containing opening is arranged on an upper side of the fourth containing cavity; the third sheet body is arranged on the first part and connected with the inner side of the outer layer, a fifth containing cavity is formed between the third sheet body and the inner side of the outer layer, a fifth containing opening is arranged on an upper side of the fifth containing cavity; the fourth sheet body is arranged on the third part and connected with the inner side of the outer layer, a sixth containing cavity is formed between the fourth sheet body and the inner side of the outer layer, and a sixth containing opening is arranged on an upper side of the sixth containing cavity.

As an improvement of the present disclosure, the card holder further includes a first connecting part, the main body is provided a first mounting hole, the flexible protective cover is provided a second mounting hole, the first cover plate is provided a third mounting hole, the first connecting part passes through the third mounting hole, the second mounting hole and the first mounting hole in sequence to detachably connect the first cover plate with the main body.

As an improvement of the present disclosure, the card holder further includes a first elastic band, the upper sidewall and the lower sidewall are connected by the first elastic band, the first elastic band tightens the upper sidewall to the lower sidewall, so that the first containing cavity for clamping the card is formed between the upper sidewall and the lower sidewall.

As an improvement of the present disclosure, the first elastic band includes a first band and a second band, the upper sidewall is provided a first side and a second side opposite to the first side, the lower sidewall is provided a third side and a fourth side opposite to the third side, one end of the first band is connected to the first side of the upper sidewall, the other end of the first band is connected to the third side of the lower sidewall, one end of the second band is connected to the second side of the upper sidewall, and the other end of the second band is connected to the fourth side of the lower sidewall.

As an improvement of the present disclosure, one end of the first band is detachably connected to the first side of the upper sidewall, the other end of the first band is detachably connected to the third side of the lower sidewall, one end of the second band is detachably connected to the second side of the upper sidewall, the other end of the second band is detachably connected to the fourth side of the lower sidewall.

As an improvement of the present disclosure, one end of the first band is provided a first rod, the other end of the first band is provided a second rod, the first side of the upper sidewall is provided a first card groove, the third side of the lower sidewall is provided a second card groove, the first rod is detachably connected to the first card groove, the second rod is detachably connected to the second card groove; one end of the second band is provided a third rod, the other end of the second band is provided a fourth rod, the second side of the upper sidewall is provided a third card groove, the fourth side of the lower sidewall is provided a fourth card groove, the third rod is detachably connected to the third card groove, and the fourth rod is detachably connected to the fourth card groove.

As an improvement of the present disclosure, the card holder further includes a second cover plate, the second cover plate is connected to the upper sidewall, the second cover plate compresses the first rod into the first card groove and the second cover plate compresses the third rod into the third card groove; the first cover plate and the first part compresses the second rod into the second card groove, the first cover plate and the first part compresses the fourth rod into the fourth card groove; the upper sidewall is provided a first groove, the lower sidewall is provided a second groove, one end of the first band is arranged into the first groove, the other end of the first band is arranged into the second groove; the first card groove and the third card groove are connected to the first groove, the second card groove and the fourth card groove are connected to the second groove; the first groove extends from the first side to the second side, and the second groove extends from the third side to the fourth side.

As an improvement of the present disclosure, the card holder further includes an elastic clamping device, the clamping device is detachably connected to the main body; the clamping device is provided a shaft foot and a clamping part, the shaft foot is connected to the clamping part, the shaft foot is connected to the main body, the shaft foot is arranged between the main body and the flexible protective cover, the flexible protective cover covers on the shaft foot, the clamping part compresses onto the first cover plate, a clamping space is formed between the clamping part and the first cover plate.

As an improvement of the present disclosure, the main body is provided with a locating groove.

As an improvement of the present disclosure, the card holder further includes a second connecting part, the upper sidewall is provided with a fourth mounting hole, the second cover plate is provided with a fifth mounting hole, the second connecting part passes through the fifth mounting hole and the fourth mounting hole in sequence to detachably connect the second cover plate with the upper sidewall.

As an improvement of the present disclosure, the first connecting part and the second connecting part are both flat head screws.

As an improvement of the present disclosure, the first sheet body, the second sheet body, the third sheet body and the fourth sheet body all are flexible sheet body.

The present disclosure has the beneficial effects: The present disclosure provides a card holder. The card holder includes the main body having the first containing cavity and the first containing opening, the first containing opening communicates with the first containing cavity, and the first containing cavity is configured for holding the cards; the flexible protective cover and the first cover plate, wherein, the flexible protective cover is arranged between the main body and the first cover plate, the first cover plate is connected to the main body, and the first cover plate compresses the flexible protective cover onto the main body. Thus, the user is able to store the card into the first containing cavity of the main body through the first containing opening to achieve the storage and management of the cards. And since the flexible protective cover is arranged, it is able to cover the main body, making the main body more attractive in appearance and more comfortable in hand feel. Furthermore, since the first cover plate is provided, the first cover plate compresses the flexible protective cover to the main body, thereby effectively realizing the installation of the flexible protective cover, preventing the flexible protective cover from falling off from the main body, and making the overall card holder smoother and more textured.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

The technical solutions in the embodiments of the present disclosure will be clearly and completely described below in conjunction with the accompanying drawings in the embodiments of the present disclosure. Apparently, the described embodiments are only a part of the embodiments of the present disclosure, rather than all the embodiments. Based on the embodiments in the present disclosure, all other embodiments obtained by those ordinarily skilled in the art without doing creative work shall fall within the protection scope of the present disclosure.

Figure 1:
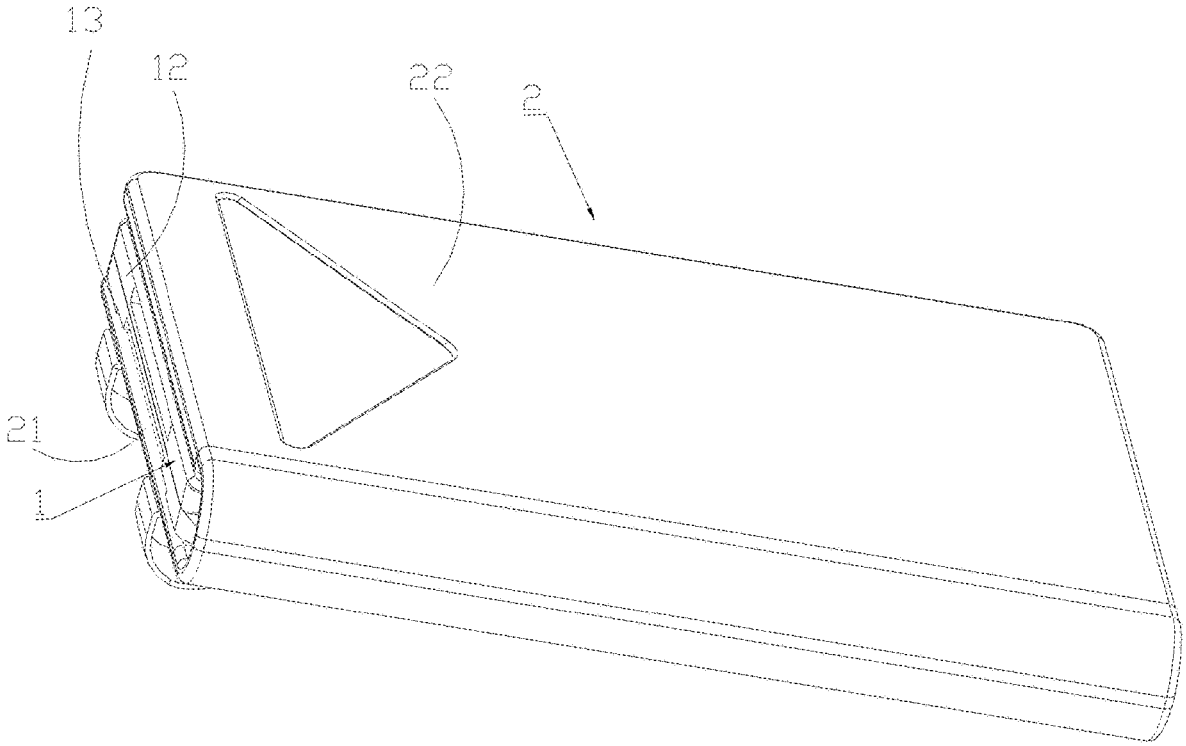
FIG. 1 is a schematic diagram of the overall structure of the present disclosure.
Figure 2:
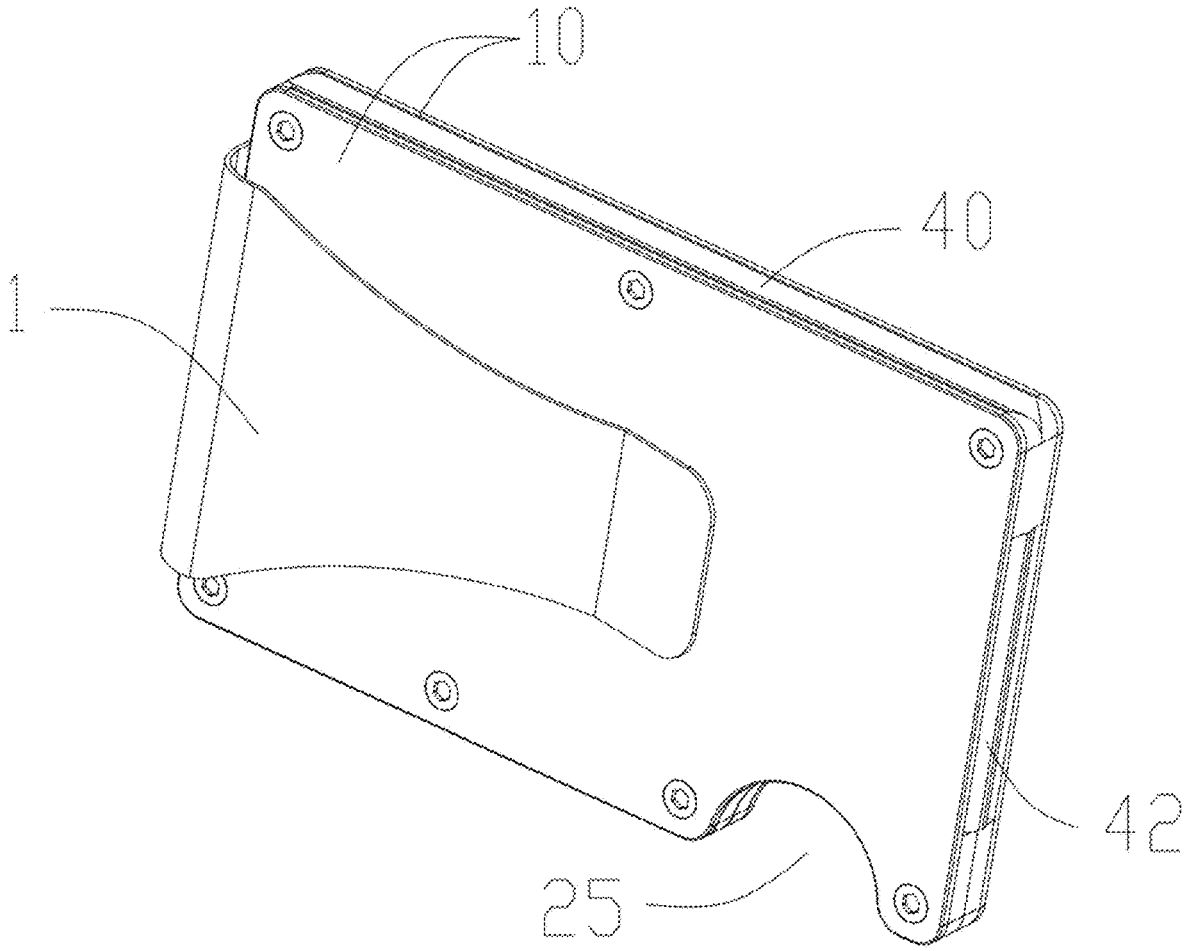
FIG. 2 is another diagram of overall structure of the present disclosure.
Figure 3:
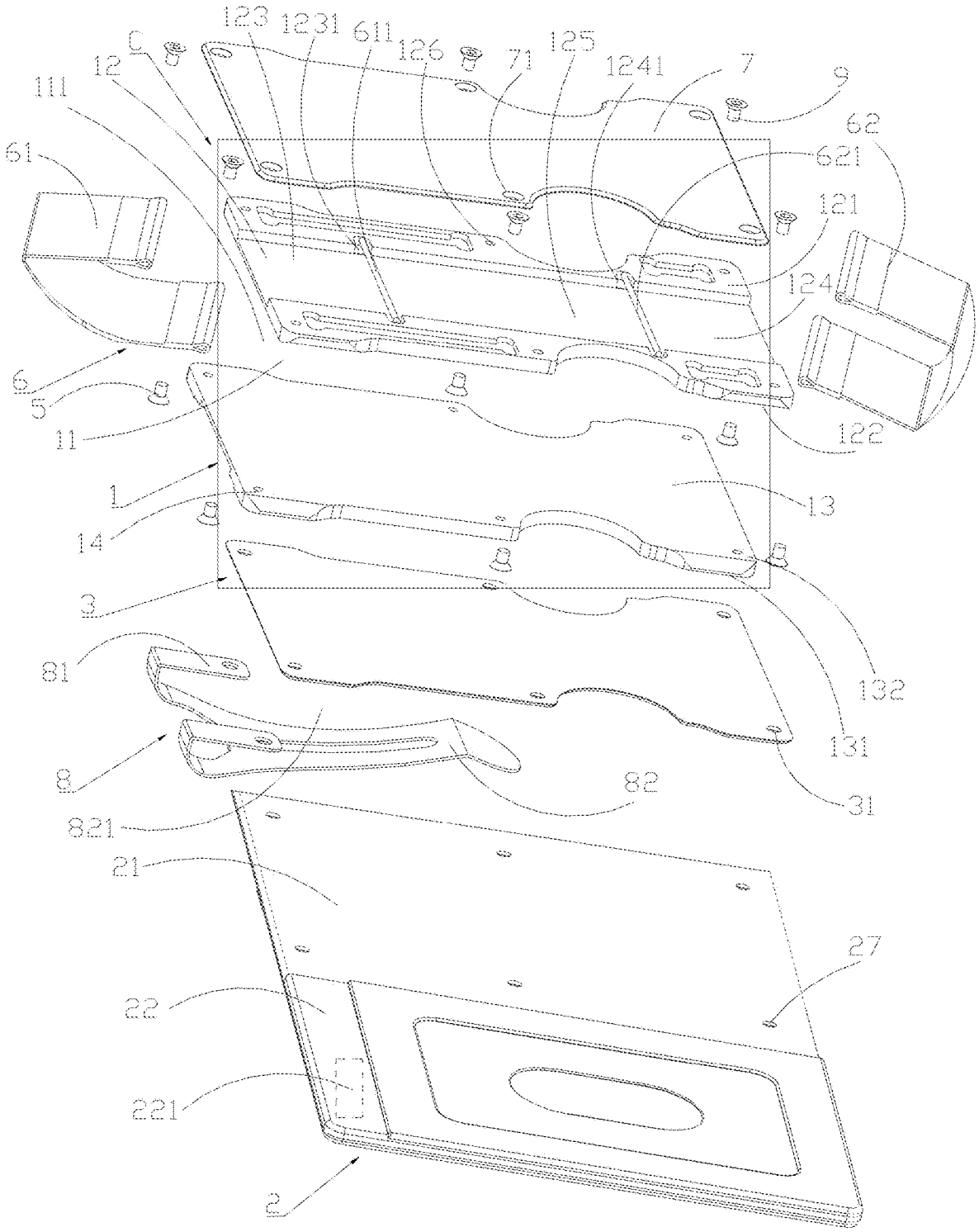
FIG. 3 is an exploded diagram of the present disclosure.
Figure 4:
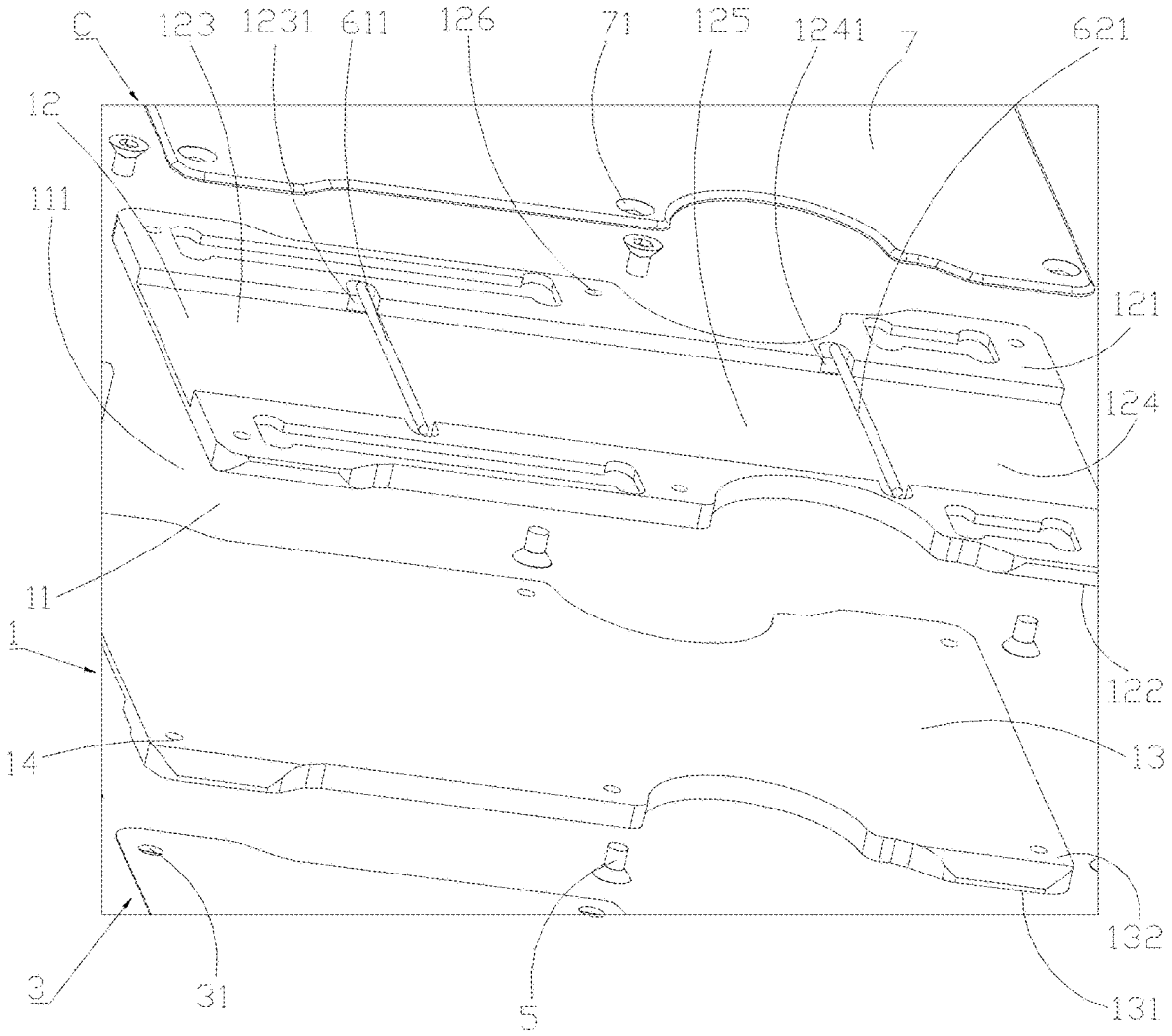
FIG. 4 is an enlarged diagram of C in FIG. 3.
Figure 5:
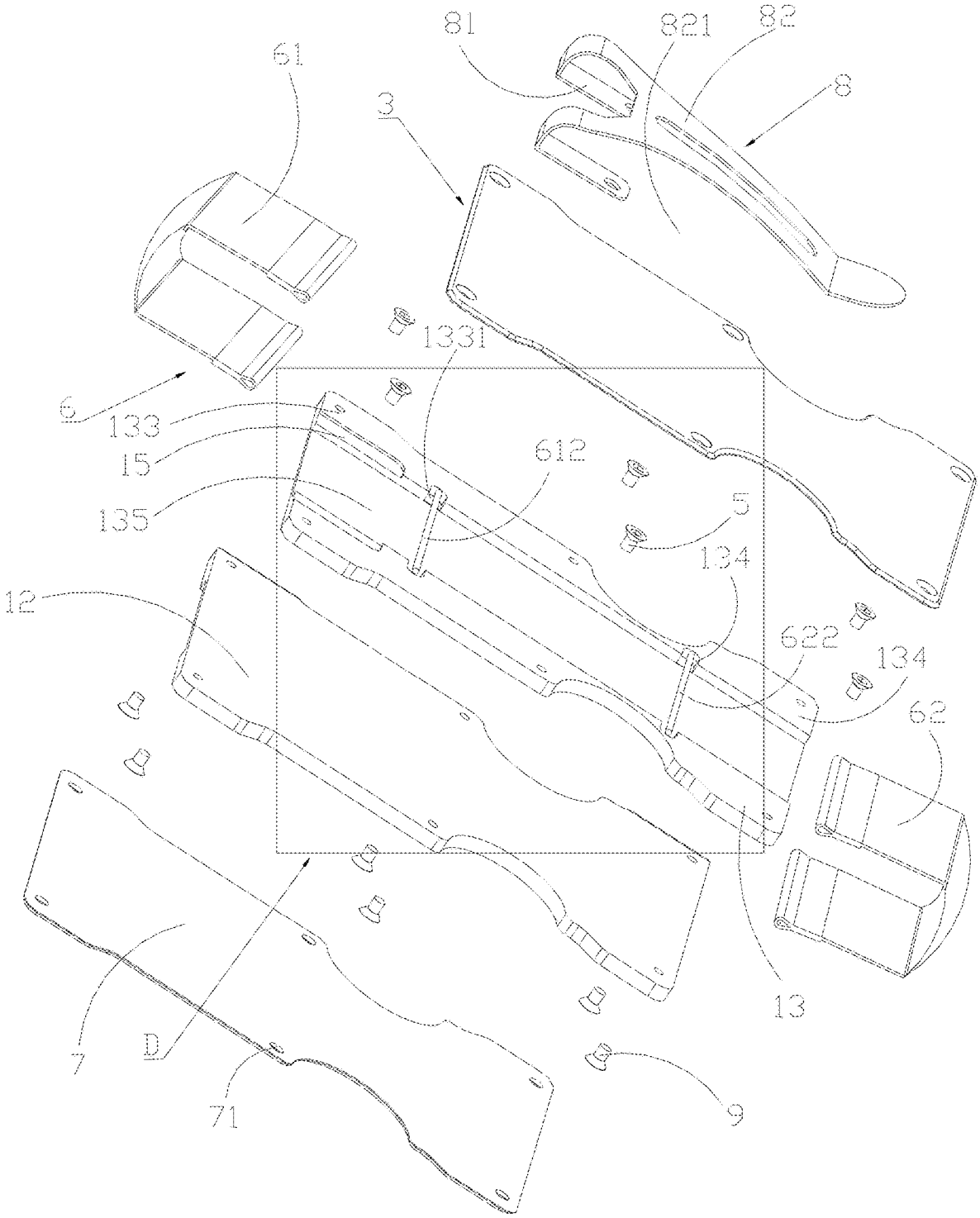
FIG. 5 is another exploded diagram of the present disclosure.
Figure 6:
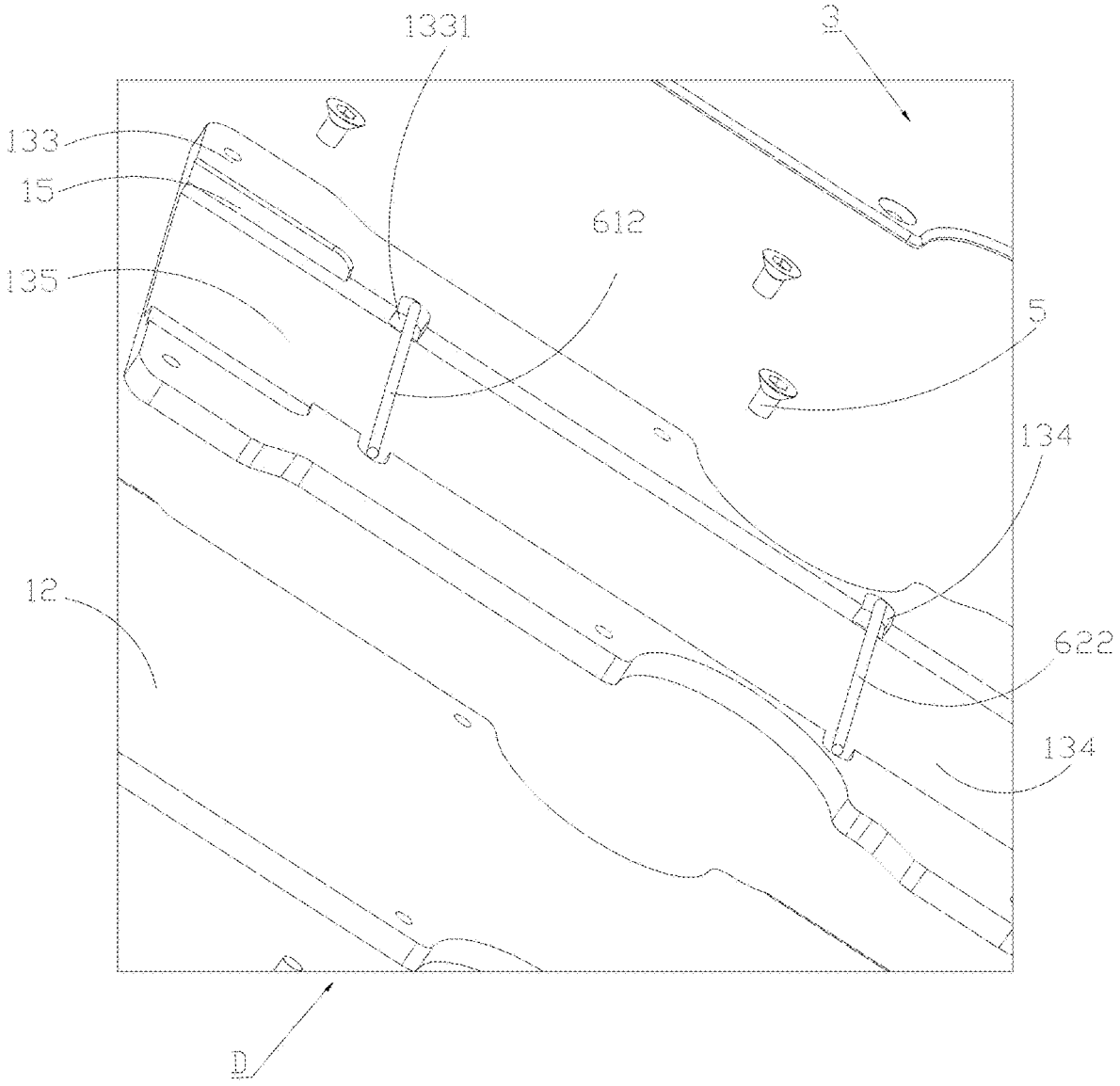
FIG. 6 is an enlarged diagram of D in FIG. 5.
Figure 7:
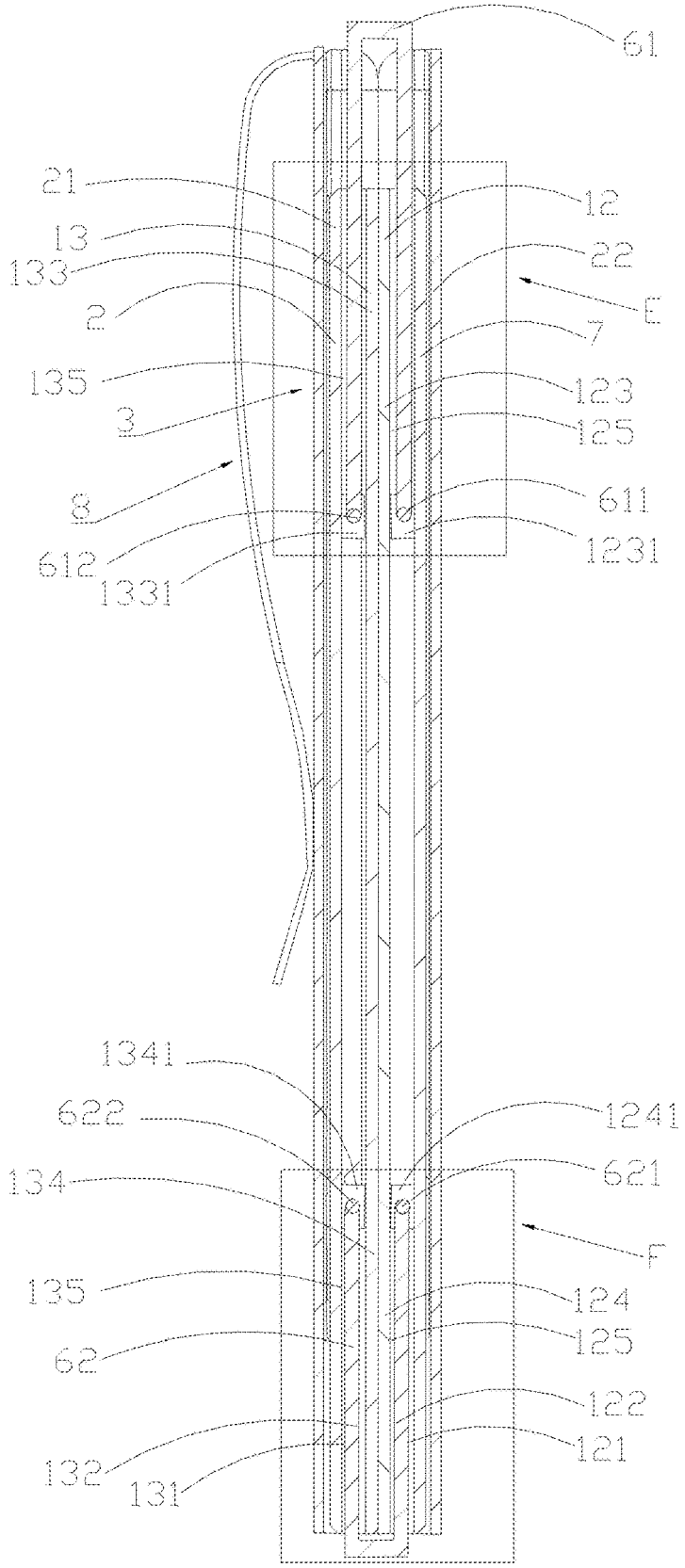
FIG. 7 is a sectional diagram cut along the clamping device, the main and the elastic band.
Figure 8:
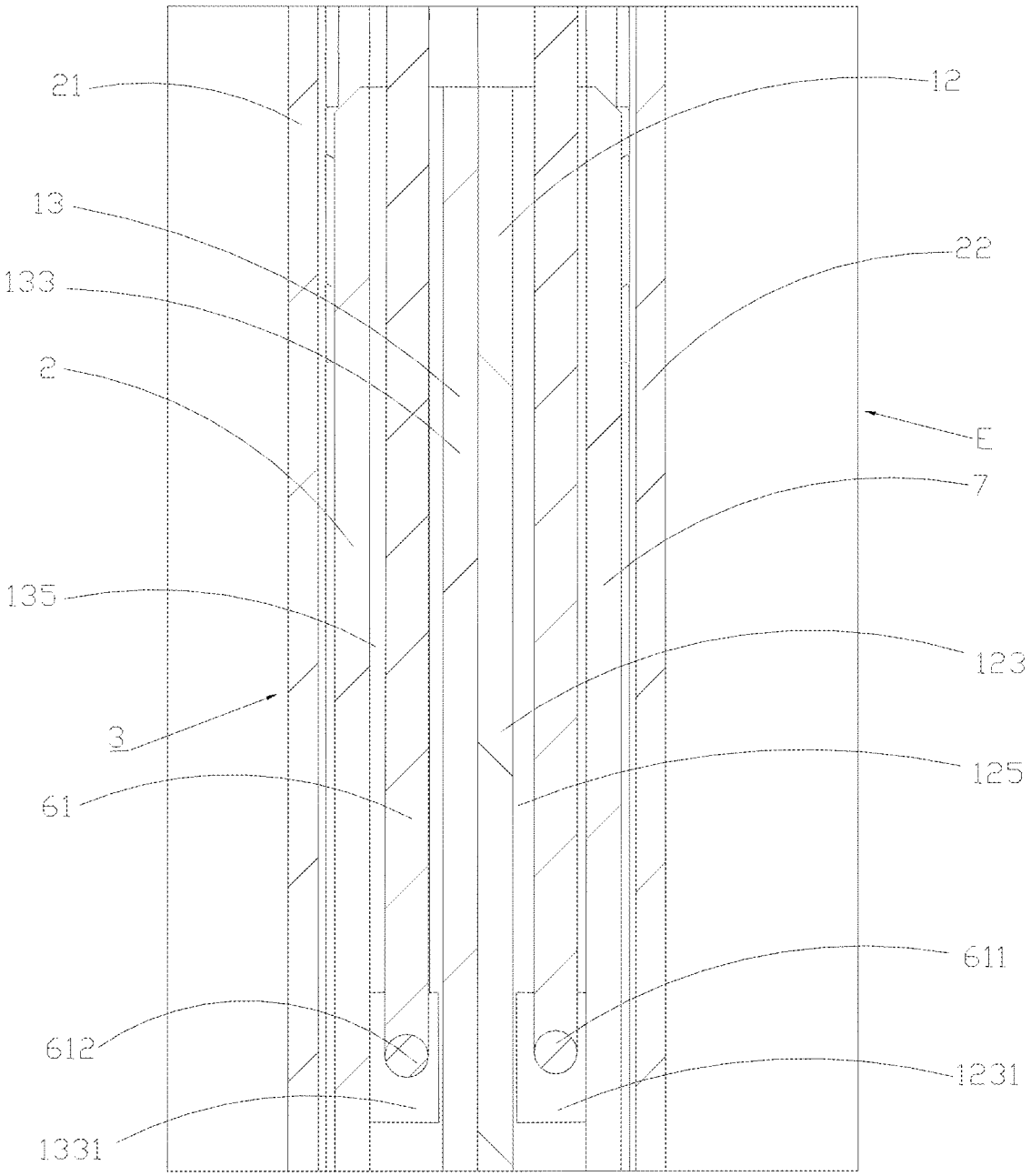
FIG. 8 is an enlarged diagram of E in FIG. 7.
Figure 9:
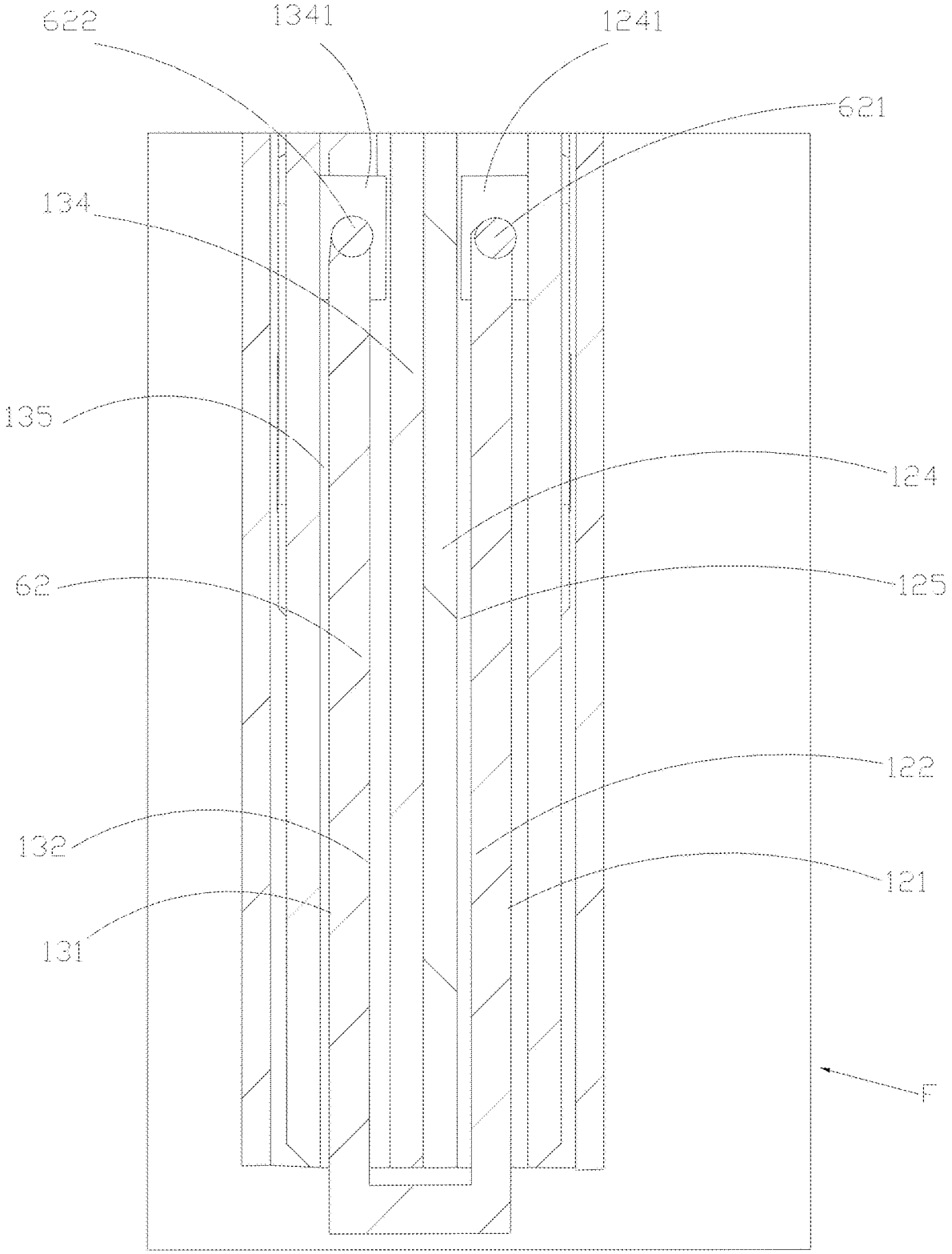
FIG. 9 is an enlarged diagram of F in FIG. 7.
Figure 10:
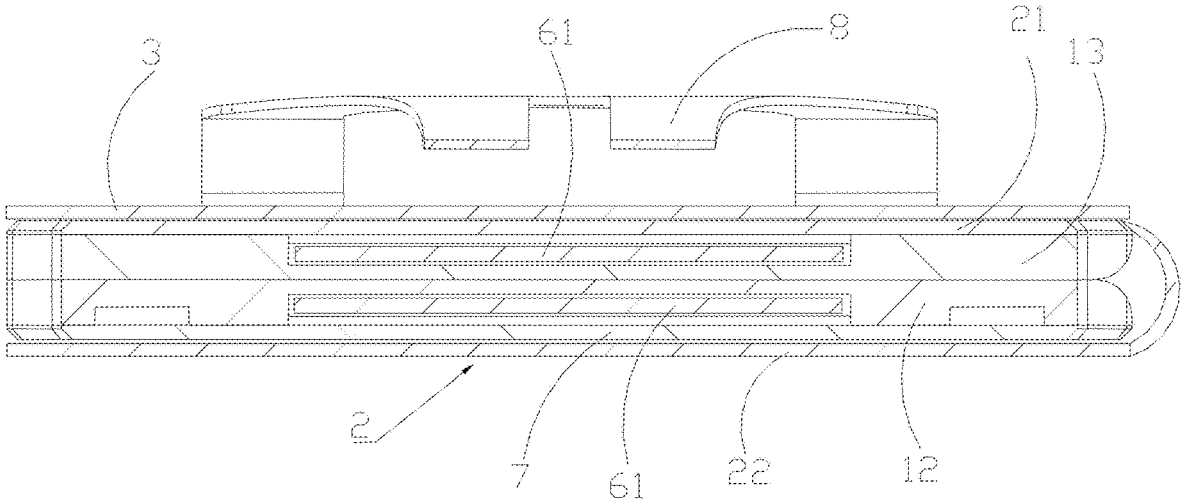
FIG. 10 is a sectional diagram cut along the clamping device, the flexible protective cover, the main body and the elastic band.
Figure 11:
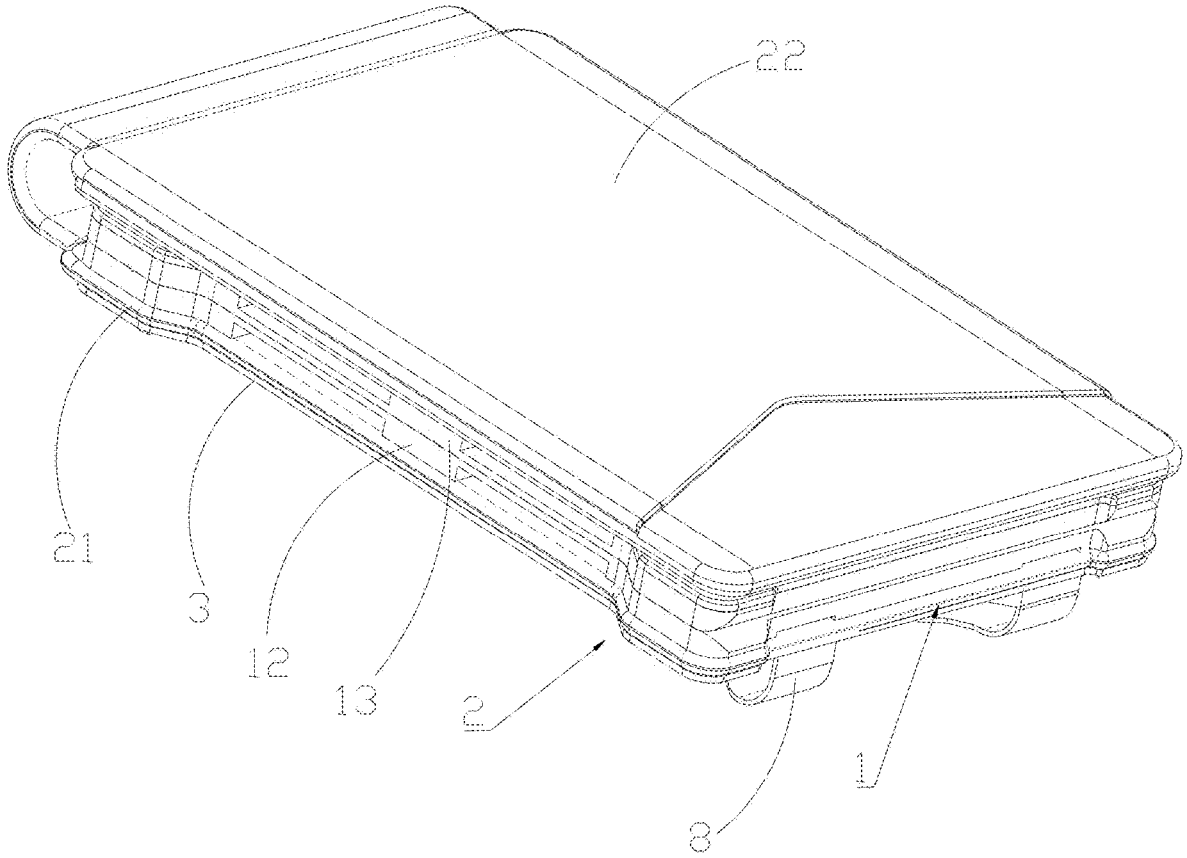
FIG. 11 is another schematic diagram of the overall structure of the present disclosure.
Figure 12:
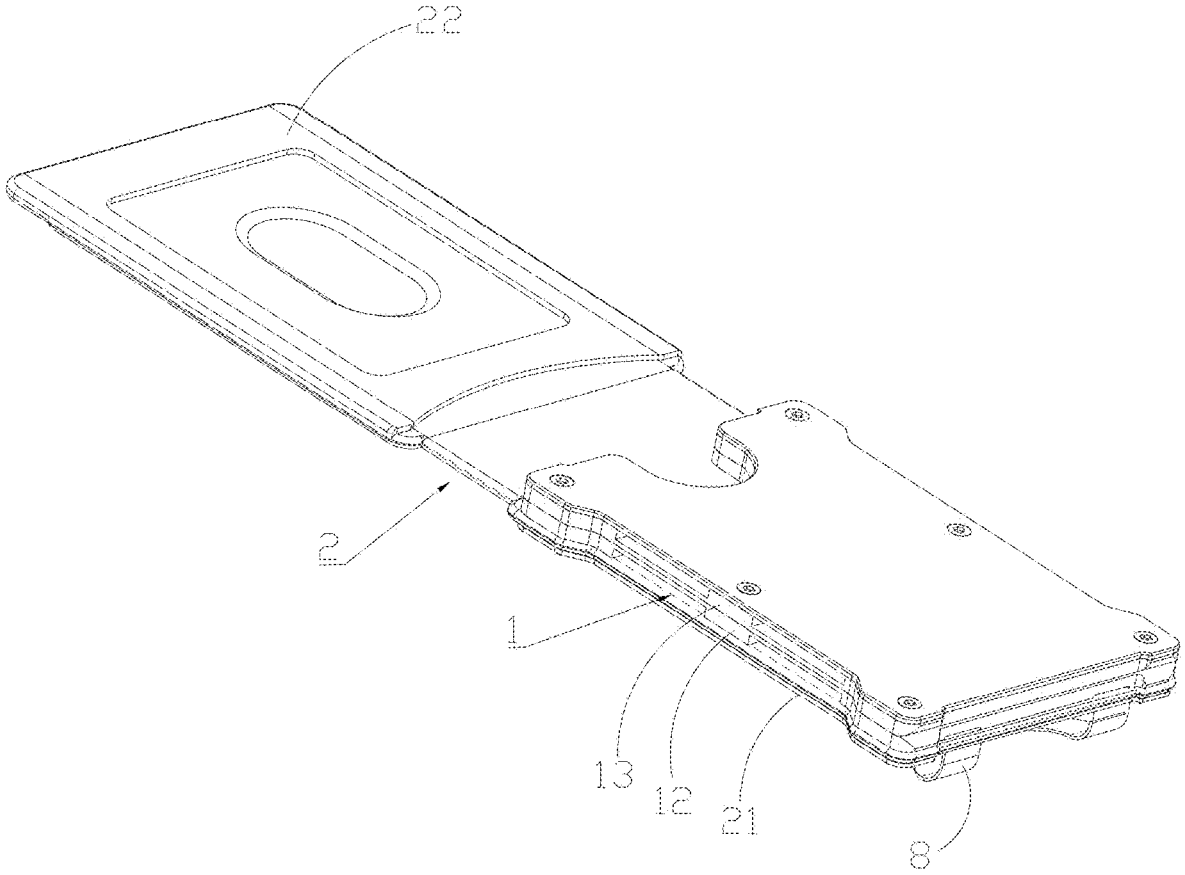
FIG. 12 is another schematic diagram of the overall structure of the present disclosure.
Figure 13:
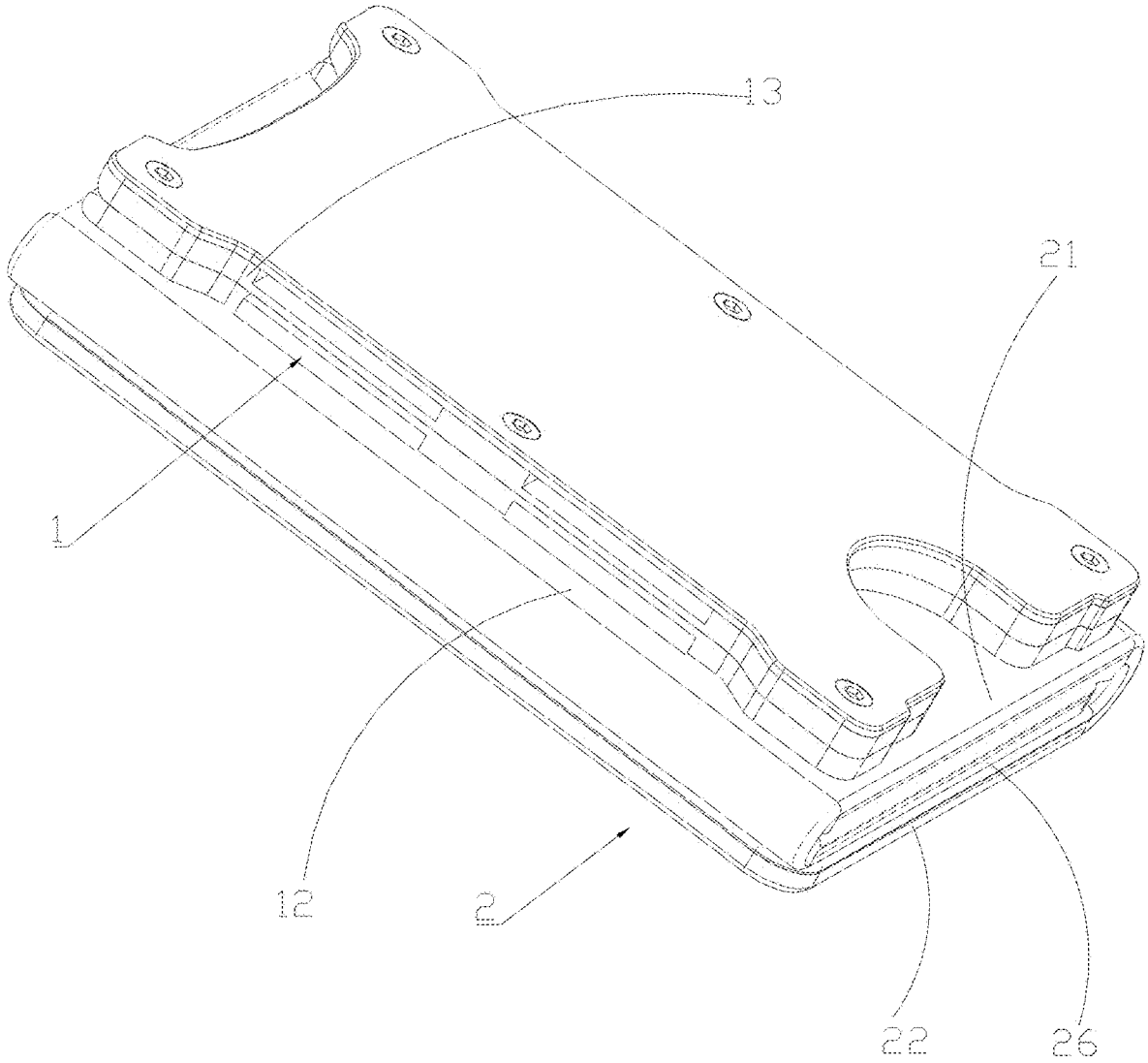
FIG. 13 is another schematic diagram of the overall structure of the present disclosure.
Figure 14:
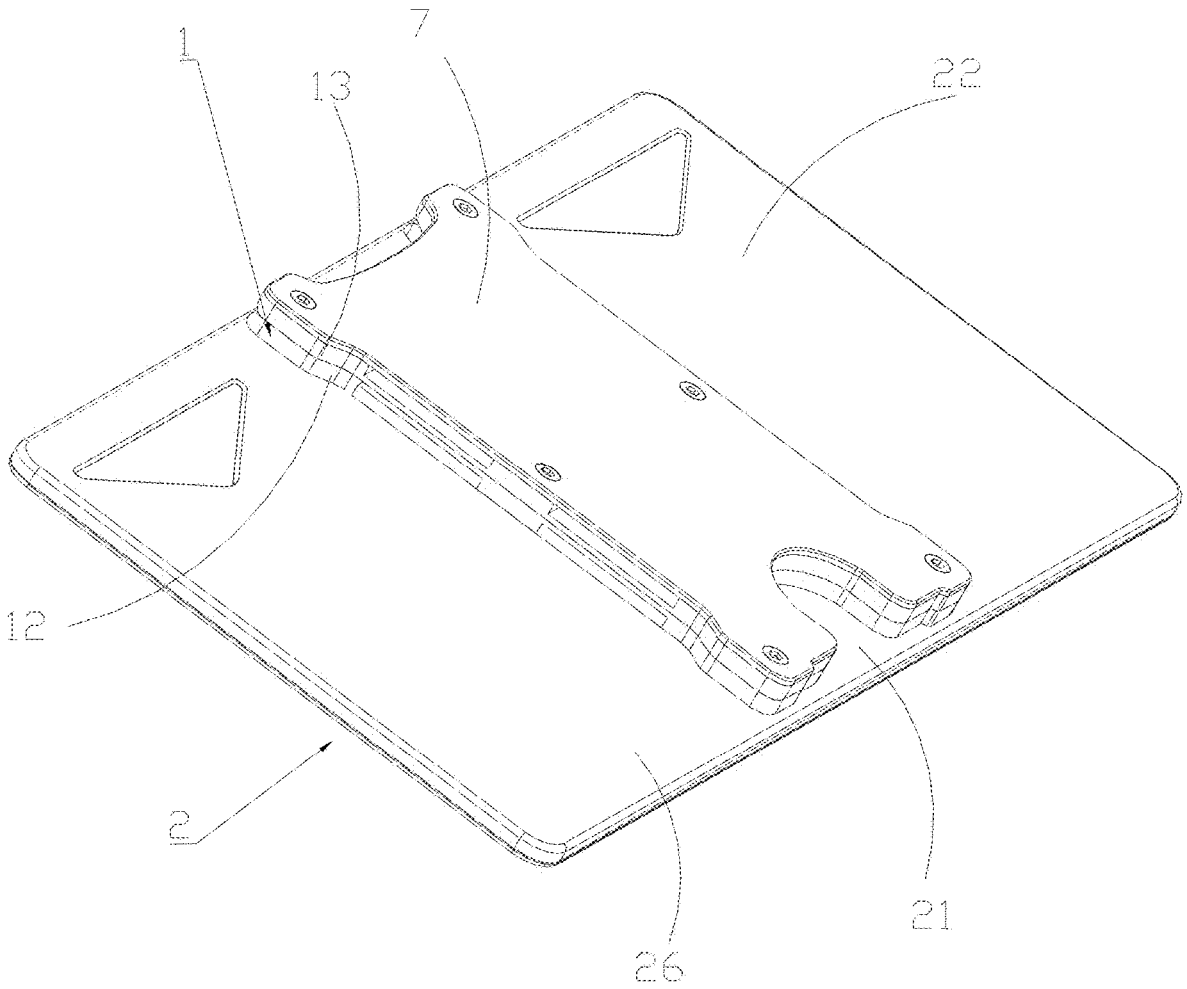
FIG. 14 is another schematic diagram of the overall structure of the present disclosure.
Figure 15:
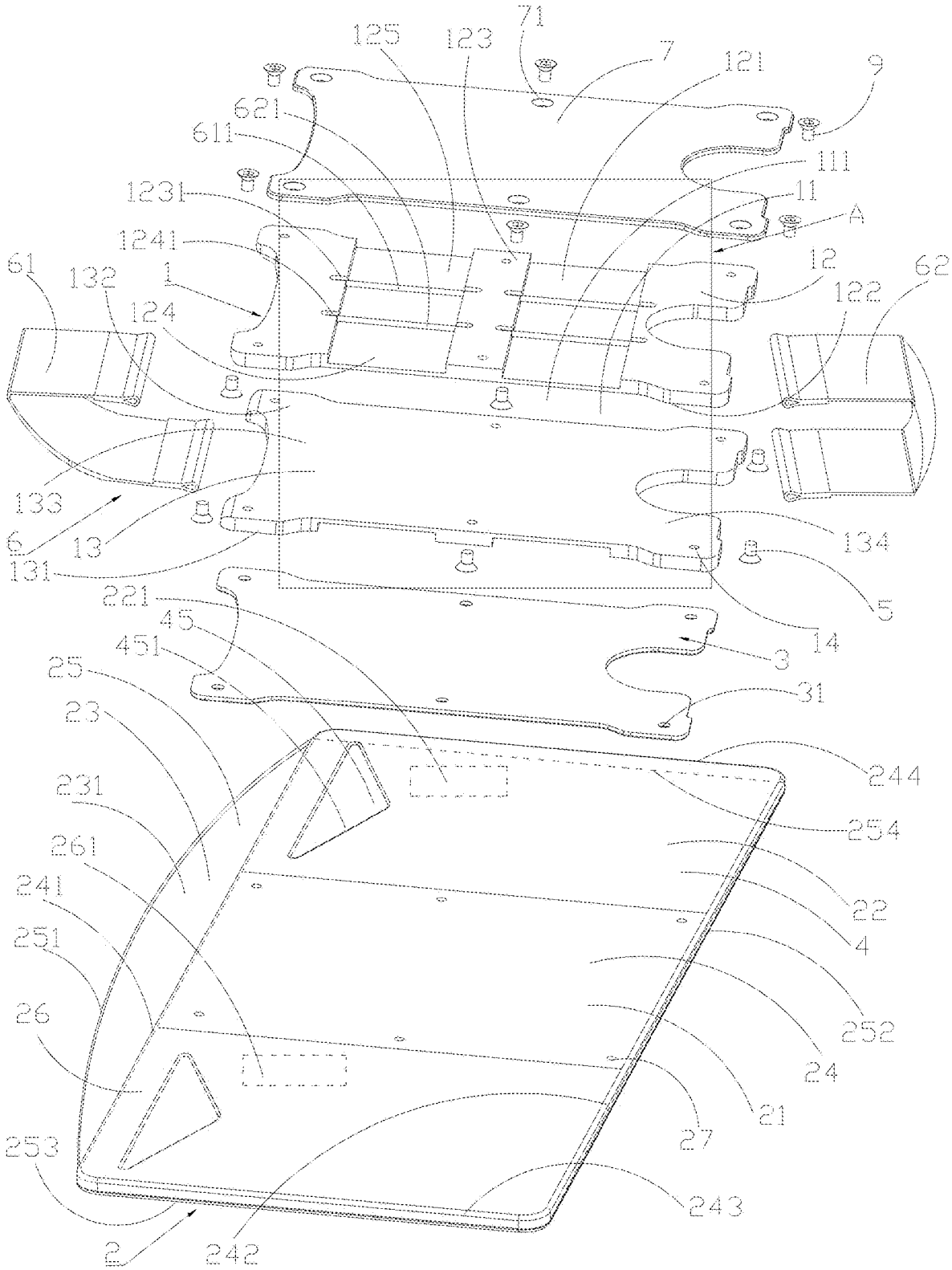
FIG. 15 is another exploded diagram of the present disclosure.
Figure 16:
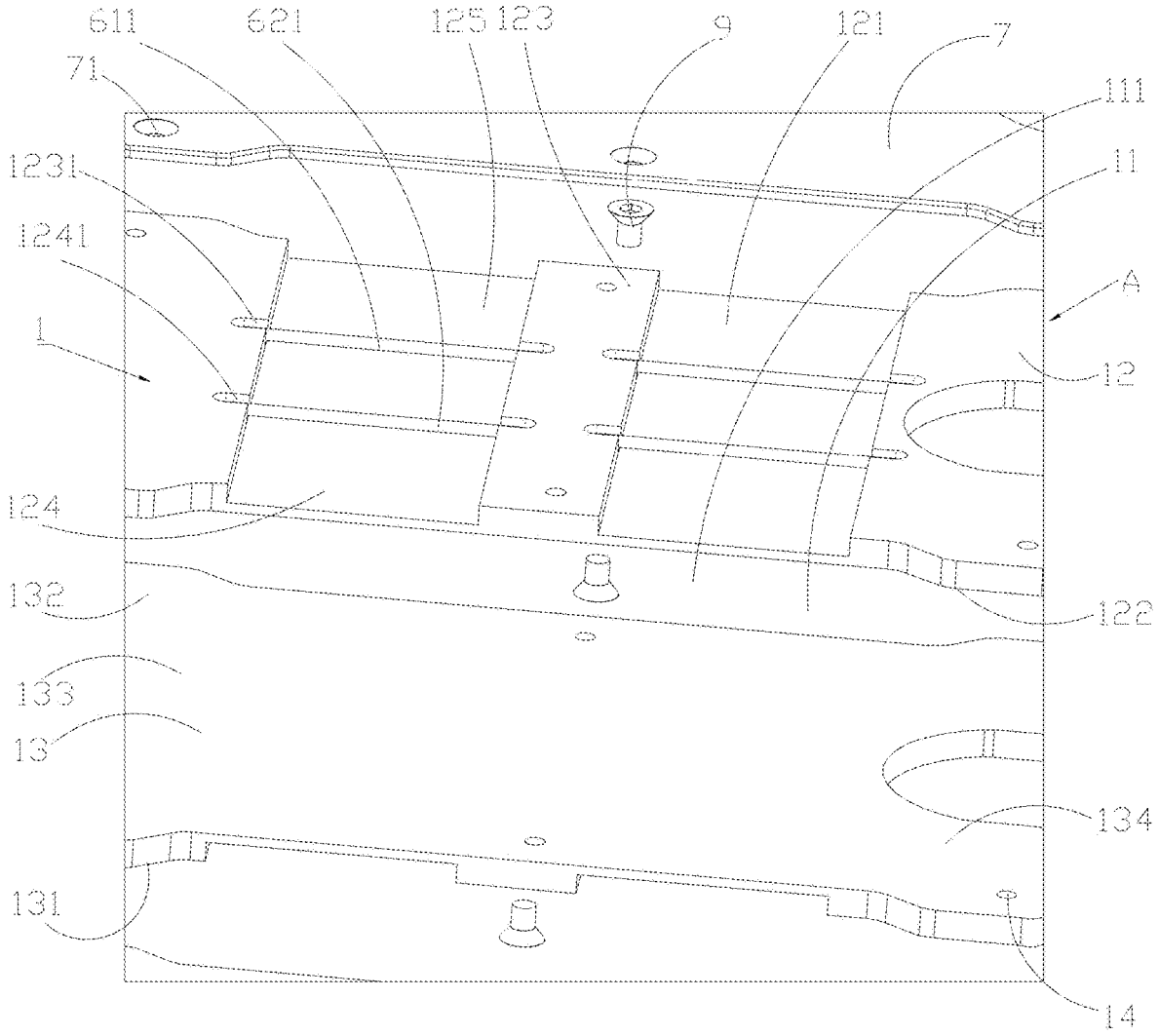
FIG. 16 is an enlarged diagram of A in FIG. 15.
Figure 17:
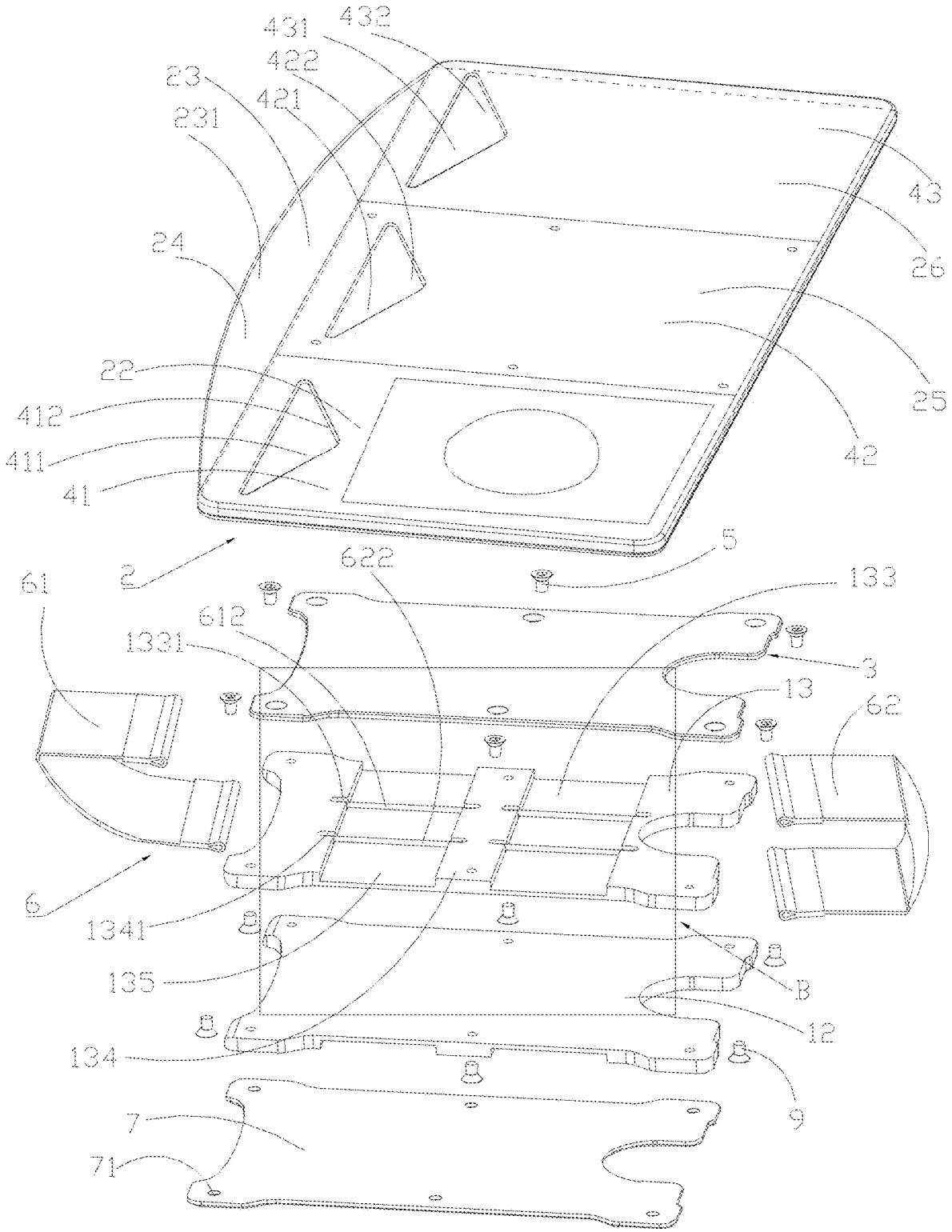
FIG. 17 is another exploded diagram of the present disclosure.
Figure 18:
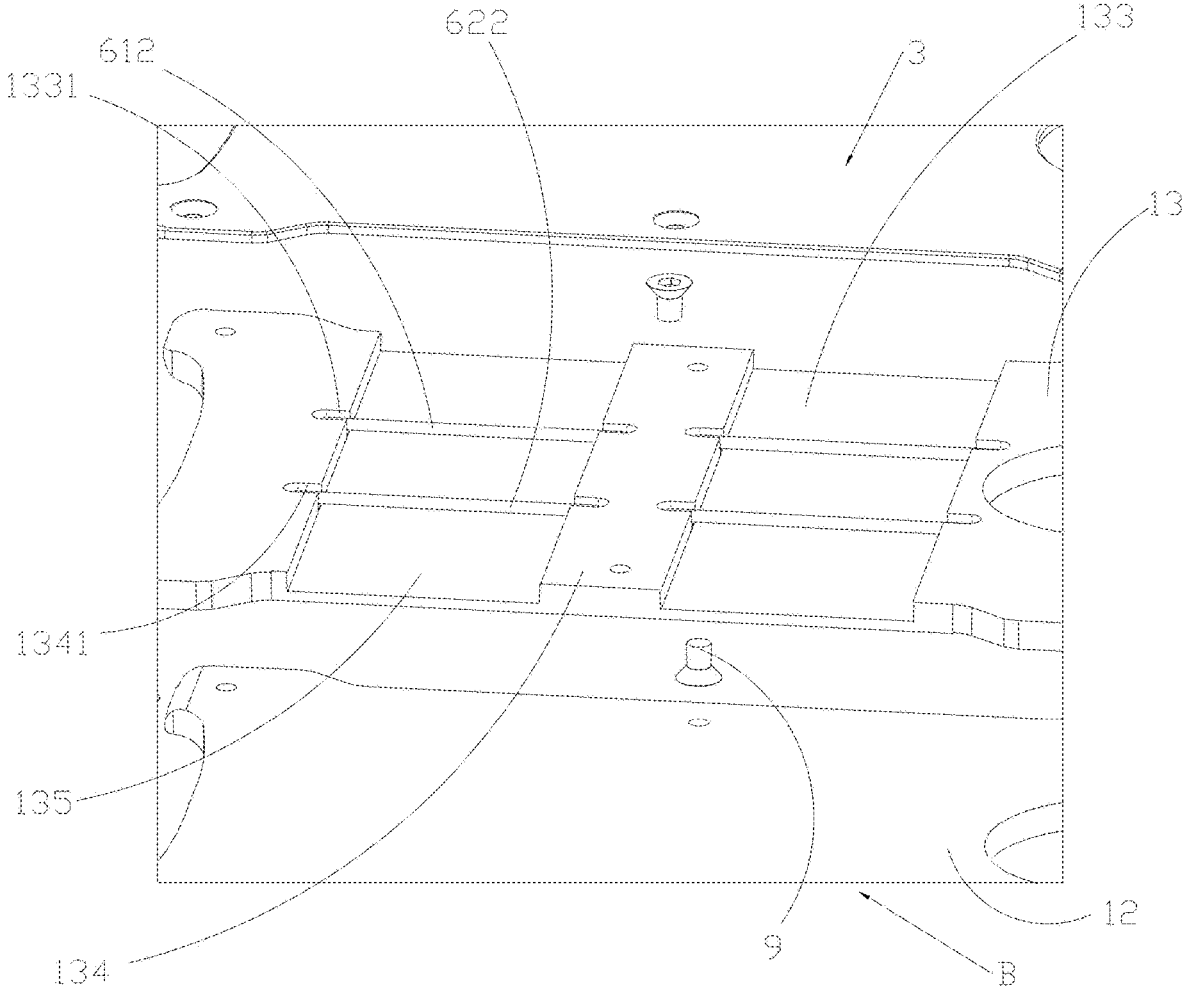
FIG. 18 is an enlarged diagram of B in FIG. 17.
Figure 19:
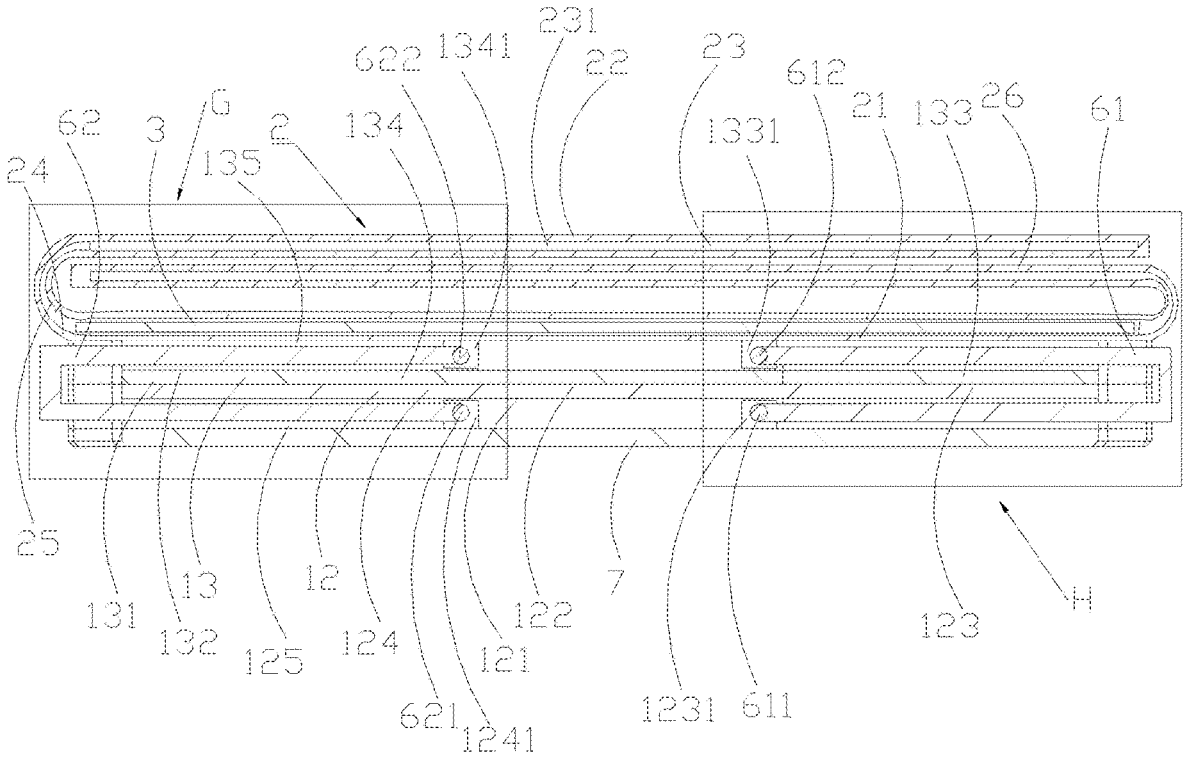
FIG. 19 is a sectional diagram cut along the clamping device, the flexible protective cover, the second containing cavity, the main body and the elastic band.
Figure 20:
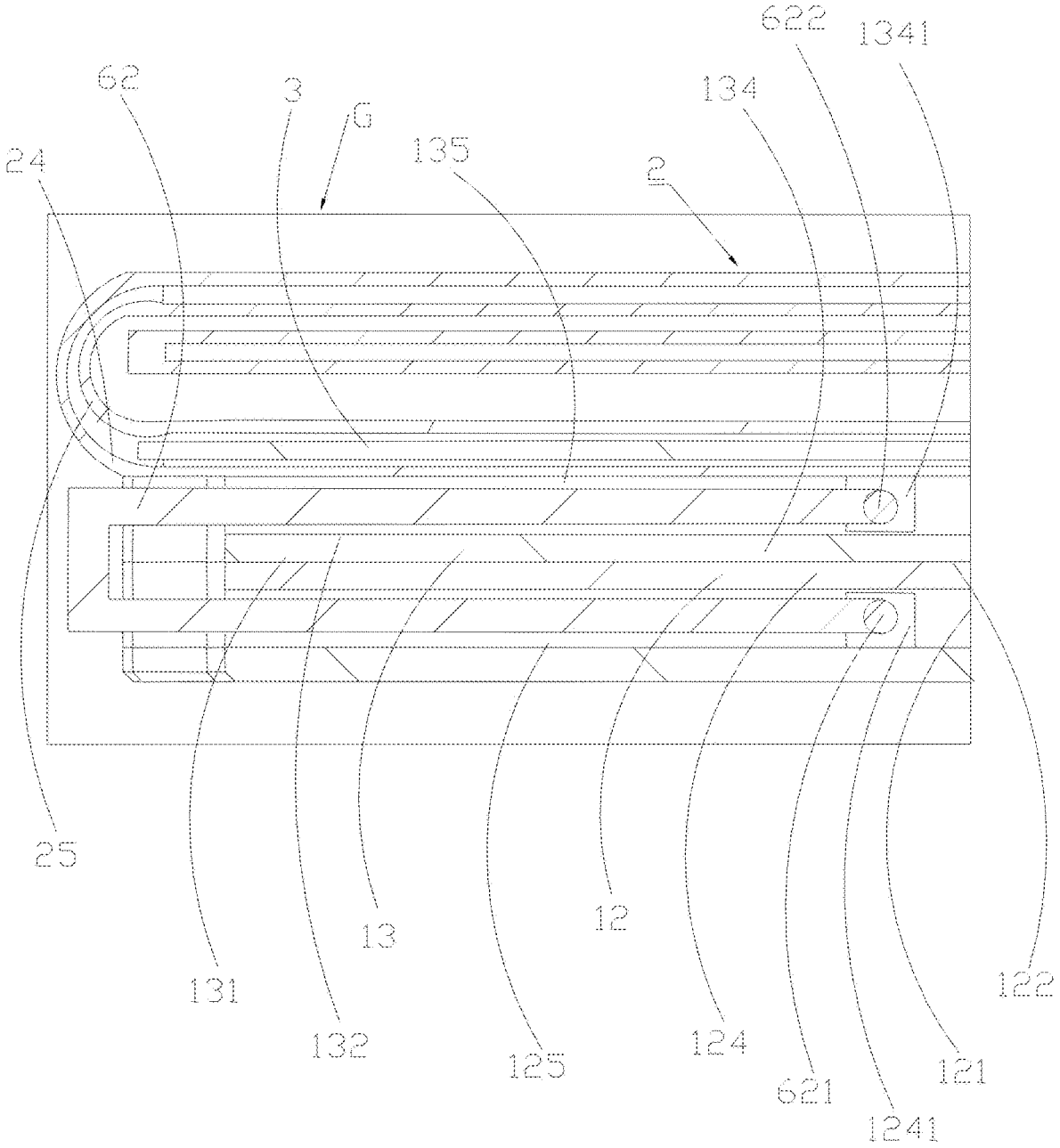
FIG. 20 is an enlarged diagram of G in FIG. 19.
Figure 21:
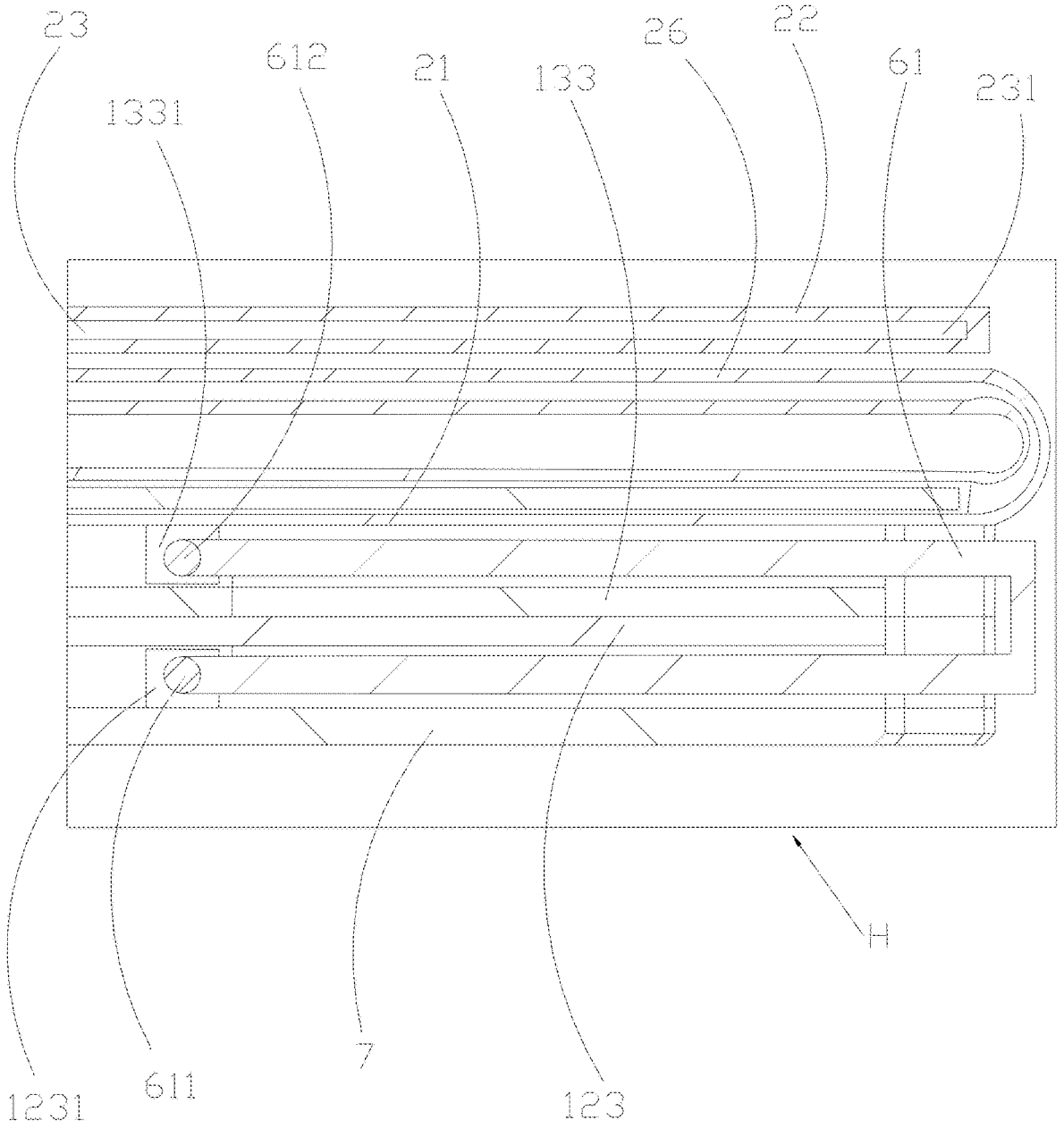
FIG. 21 is an enlarged diagram of H in FIG. 19.

Referring to FIG. 1 to FIG. 21, a card holder includes a main body 1 having a first containing cavity 11 and a first containing opening 111, the first containing opening 111 communicates with the first containing cavity 11, the first containing cavity 11 is configured for holding the cards; a flexible protective cover 2 and a first cover plate 3, wherein the flexible protective cover 2 is arranged between the main body 1 and the first cover plate 3, the first cover plate 3 is connected to the main body 1, and the first cover plate 3 compresses the flexible protective cover 2 onto the main body 1.

Through the above structure, the card holder includes the main body 1 having the first containing cavity 11 and the first containing opening 111, the first containing opening 111 communicates with the first containing cavity 11, and the first containing cavity 11 is configured for holding the cards; the flexible protective cover 2 and the first cover plate 3, wherein, the flexible protective cover 2 is arranged between the main body 1 and the first cover plate 3, the first cover plate 3 is connected to the main body 1, and the first cover plate 3 compresses the flexible protective cover 2 onto the main body 1. Thus, the user is able to store the card into the first containing cavity 11 of the main body 1 through the first containing opening 111 to achieve the storage and management of the cards. And since the flexible protective cover 2 is arranged, it is able to cover the main body 1, making the main body 1 more attractive in appearance and more comfortable in hand feel. Furthermore, since the first cover plate 3 is provided, the first cover plate 3 compresses the flexible protective cover 2 to the main body 1, thereby effectively realizing the installation of the flexible protective cover 2, preventing the flexible protective cover 2 from falling off from the main body 1, and making the overall card holder smoother and more textured.

In this embodiment, the flexible protective cover 2 includes a first part 21 and a second part 22, the first part 21 and the second part 22 are rotatably connected, the first part 21 is arranged between the main body 1 and the first cover plate 3, and the first cover plate 3 compresses the first part 21 onto the main body 1. Wherein the main body 1 includes a upper sidewall 12 and a lower sidewall 13, the upper sidewall 12 includes a first outer surface 121 and a first inner surface 122, the lower sidewall 13 includes a second outer surface 131 and a second inner surface 132, the first containing cavity 11 is formed between the first inner surface 122 and the second inner surface 132, the first part 21 is arranged between the second outer surface 131 and the first cover plate 3, the first cover plate 3 is connected with the second outer surface 131, and the first cover plate 3 compresses the first part 21 onto the second outer surface 131. Through the above structure, the installation of the flexible protective cover 2 is effectively realized, and the second part 22 is able to be rotated to cover the first outer surface 121 or to be stacked with the first part 21.

Referring to FIG. 1 to FIG. 12, in some embodiments, the second part 22 is able to rotate to cover the first outer surface 121 of the upper sidewall 12. Wherein when the second part 22 rotates to cover the first outer surface 121 of the upper sidewall 12, the second part 22 is connected with the upper sidewall 12 by magnetic force. Wherein the second part 22 is provided with a first magnetic attraction part 221, the upper sidewall 12 is a metal upper sidewall 12, when the second part 22 rotates to cover the first outer surface 121 of the upper sidewall 12, the second part 22 is adsorbed onto the upper sidewall 12 by the first magnetic attraction part 221. Through the above structure, the second part 22 is able to rotate to cover the first outer surface 121, and the second part 22 is connected with the upper sidewall 12 by magnetic force to wrap the main body 1, which is convenient for the user to carry the main body 1. And a third containing cavity 45 is formed between a first sheet body 4 and a third outer surface of the second part 22, the third containing cavity 45 is also able to storage cards. So as to increase the storage space of the card holder, which is convenient for the user to classify and manage cards. Further, since a third containing opening 451 is V-shaped, which is convenient for the user to take and place the card through the third containing opening 451.

Referring to FIG. 13 to FIG. 21, in some embodiments, the flexible protective cover 2 is further provided a second containing cavity 23 and a second containing opening 231, the second containing opening 231 is connected to the second containing cavity 23, the second containing cavity 23 is configured for holding paper currency. Through the above structure, the user is also able to put change such as paper currency, coins and so on into the second containing cavity 23 of the flexible protective cover 2 to realize the function of storing the change, so that the card holder has the functions of a card holder and a money clip at the same time. Wherein the protective cover 2 includes an inner layer 24 and an outer layer 25, the inner layer 24 is arranged between the first cover plate 3 and the main body 1, and the first cover plate 3 compresses the inner layer 24 onto the main body 1; the inner layer 24 is connected with the outer layer 25, and the second containing cavity 23 is formed between the inner layer 24 and the outer layer 25. Specifically, the inner layer 24 is provided with a first bottom edge 241, a first top edge 242 opposite the first bottom edge 241, a first left edge 243 connecting the first bottom edge 241 to the first top edge 242 and a first right edge 244; the outer layer 25 is provided with a second bottom edge 251, a second top edge 252 opposite the second bottom edge 251, a second left edge 253 connecting the second bottom edge 251 to the second top edge 252 and a second right edge 254; the first bottom edge 241 is connected with the second top edge 252, the first left edge 243 is connected with the second left edge 253, the first right edge 244 is connected with the second right edge 254, such that the inner layer 24 is connected with the outer layer 25, the second containing cavity 23 is formed between the inner layer 24 and the outer layer 25, and the second containing opening 231 is arranged between the first top edge 242 and the second top edge 252. Through the above structure, the connection between the inner layer 24 and the outer layer 25 is effectively realized, so that the user is able to put change such as paper currency, coins into the second containing cavity 23 between the inner layer 24 and the outer layer 25 through the second containing opening 231.

Referring to FIG. 13 to FIG. 21, the main part of the flexible protective cover 2 further includes a third part 26, the second part 22 is rotatably connected with one side of the first part 21, the third part 26 is rotatably connected with the other side of the first part 21, the third part 26 is able to be rotated to cover the first part 21, and the second part 22 is able to be rotated to cover the third part 26. Wherein the third part 26 is connected with the second part 22 by magnetic force; the second part 22 is provided with the first magnetic attraction part 221, the third part 26 is provided with a first magnetic attraction matching part 261, when the third part 26 rotates to cover the first part 21 and the second part 22 rotates to cover the third part 26, the first magnetic attraction part 221 is connected with the first magnetic attraction matching part 261 by magnetic force. Specifically, the flexible protective cover 2 is further provided with the second containing cavity 23 and the second containing opening 231, the second containing opening 231 is connected with the second containing cavity 23, the second containing cavity 23 is configured for holding paper currency, the second containing cavity 23 extends between the first part 21, the second part 22 and the third part 26, and the second containing opening 231 extends between the first part 21, the second part 22 and the third part 26. Furthermore, the card holder further includes a first sheet body 4, a second sheet body 41, a third sheet body 42 and a fourth sheet body 43, the flexible protective cover 2 includes the inner layer 24 and the outer layer 25, the inner layer 24 is connected with the outer layer 25, the first sheet body 4 is arranged on the second part 22 and connected with an outer side of the outer layer 25, the third containing cavity 45 is formed between the first sheet body 4 and the outer side of the outer layer 25, the third containing opening 451 is arranged on an upper side of the third containing cavity 45; the second sheet body 41 is arranged on the second part 22 and connected with an inner side of the outer layer 25, a fourth containing cavity 411 is formed between the second sheet body 41 and the inner side of the outer layer 25, a fourth containing opening 412 is arranged on an upper side of the fourth containing cavity 411; the third sheet body 42 is arranged on the first part 21 and connected with the inner side of the outer layer 25, a fifth containing cavity 421 is formed between the third sheet body 42 and the inner side of the outer layer 25, a fifth containing opening 422 is arranged on an upper side of the fifth containing cavity 421; the fourth sheet body 43 is arranged on the third part 26 and connected with the inner side of the outer layer 25, a sixth containing cavity 431 is formed between the fourth sheet body 43 and the inner side of the outer layer 25, and a sixth containing opening 432 is arranged on an upper side of the sixth containing cavity 431. Furthermore, the third containing opening 451, the fourth containing opening 412, the fifth containing opening 422, the sixth containing opening 432 and a seventh containing opening 442 all are V-shaped. Through the above structure, the second containing cavity 23 extends between the first part 21, the second part 22 and the third part 26, and the second containing opening 231 extends between the first part 21, the second part 22 and the third part 26, such that the space of the second containing cavity 23 is increased, the second containing cavity 23 is able to store more paper currency and change. And when the third part 26 rotates to cover the first part 21, and the second part 22 rotates to cover the third part 26, the first magnetic attraction part 221 is connected with the first magnetic attraction matching part 261 by magnetic force, so that the first part 21, the second part 22 and the third part 26 are stacked to facilitate the user to carry the card holder. Furthermore, since the flexible protective cover 2 is further provided with the third containing cavity 45, the fourth containing cavity 411, the fifth containing cavity 421, the sixth containing cavity 431 and a seventh containing cavity 441, so that the store space of the cards is further increased, which is convenient for the user to classify and manage cards. And since the third containing opening 451, the fourth containing opening 412, the fifth containing opening 422, the sixth containing opening 432 and the seventh containing opening 442 all are V-shaped, which is convenient for the user to take and place the card through the third containing opening 451, the fourth containing opening 412, the fifth containing opening 422, the sixth containing opening 432 and the seventh containing opening 442.

In this embodiment, the card holder further includes a first connecting part 5, the main body 1 is provided with a first mounting hole 14, the flexible protective cover 2 is provided with a second mounting hole 27, the first cover plate 3 is provided with a third mounting hole 31, the first connecting part 5 passes through the third mounting hole 31, the second mounting hole 27 and the first mounting hole 14 in sequence to detachably connect the first cover plate 3 with the main body 1. Through the above structure, the design is reasonable, the first cover plate 3, the main body 1 and the flexible protective cover 2 are able to conveniently mount and dismount.

In this embodiment, the card holder further includes a first elastic band 6, the upper sidewall 12 and the lower sidewall 13 are connected by the first elastic band 6, the first elastic band 6 tightens the upper sidewall 12 to the lower sidewall 13, so that the first containing cavity 11 for clamping the card is formed between the upper sidewall 12 and the lower sidewall 13. Wherein the first elastic band 6 includes a first band 61 and a second band 62, the upper sidewall 12 is provided a first side 123 and a second side 124 opposite to the first side 123, the lower sidewall 13 is provided a third side 133 and a fourth side 134 opposite to the third side 133, one end of the first band 61 is connected to the first side 123 of the upper sidewall 12, the other end of the first band 61 is connected to the third side 133 of the lower sidewall 13, one end of the second band 62 is connected to the second side 124 of the upper sidewall 12, and the other end of the second band 62 is connected to the fourth side 134 of the lower sidewall 13. Specifically, one end of the first band 61 is detachably connected to the first side 123 of the upper sidewall 12, the other end of the first band 61 is detachably connected to the third side 133 of the lower sidewall 13, one end of the second band 62 is detachably connected to the second side 124 of the upper sidewall 12, the other end of the second band 62 is detachably connected to the fourth side 134 of the lower sidewall 13. Furthermore, one end of the first band 61 is provided a first rod 611, the other end of the first band 61 is provided a second rod 612, the first side 123 of the upper sidewall 12 is provided a first card groove 1231, the third side 133 of the lower sidewall 13 is provided a second card groove 1331, the first rod 611 is detachably connected to the first card groove 1231, the second rod 612 is detachably connected to the second card groove 1331; one end of the second band 62 is provided a third rod 621, the other end of the second band 62 is provided a fourth rod 622, the second side 124 of the upper sidewall 12 is provided a third card groove 1241, the fourth side 134 of the lower sidewall 13 is provided a fourth card groove 1341, the third rod 621 is detachably connected to the third card groove 1241, and the fourth rod 622 is detachably connected to the fourth card groove 1341. Furthermore, the card holder further includes a second cover plate 7, the second cover plate 7 is connected to the upper sidewall 12, the second cover plate 7 compresses the first rod 611 into the first card groove 1231 and the second cover plate 7 compresses the third rod 621 into the third card groove 1241; the first cover plate 3 and the first part 21 compresses the second rod 612 into the second card groove 1331, the first cover plate 3 and the first part 21 compresses the fourth rod 622 into the fourth card groove 1341; the upper sidewall 12 is provided a first groove 125, the lower sidewall 13 is provided a second groove 135, one end of the first band 61 is arranged into the first groove 125, the other end of the first band 61 is arranged into the second groove 135; the first card groove 1231 and the third card groove 1241 are connected to the first groove 125, the second card groove 1331 and the fourth card groove 1341 are connected to the second groove 135; the first groove 125 extends from the first side 123 to the second side 124, and the second groove 135 extends from the third side 133 to the fourth side 134. Through the above structure, not only the installation between the upper sidewall 12 and the lower sidewall 13 is realized, but also the upper sidewall 12 is tightened to the lower sidewall 13 by the first elastic band 6, so that the first containing cavity 11 for clamping the card is formed between the upper sidewall 12 and the lower sidewall 13. The user is able to separate the upper sidewall 12 from the lower sidewall 13 by stretching the first elastic band 6 to increase the distance between the upper sidewall 12 and the lower sidewall 13, so that the user is able to put the card into the first containing cavity 11 through the first containing opening 111, then release the first elastic band 6 after the card is placed, the elastic return force provided by the first elastic band 6 tightens the upper sidewall 12 to the lower sidewall 13, so that the upper sidewall 12 and the lower sidewall 13 clamp the card in the first containing cavity 11.

Referring to FIG. 1 to FIG. 12, the card holder further includes an elastic clamping device 8, the clamping device 8 is detachably connected to the main body 1; the clamping device 8 is provided a shaft foot 81 and a clamping part 82, the shaft foot 81 is connected to the clamping part 82, the shaft foot 81 is connected to the main body 1, the shaft foot 81 is arranged between the main body 1 and the flexible protective cover 2, the flexible protective cover 2 covers on the shaft foot 81, the clamping part 82 compresses onto the first cover plate 3, a clamping space 821 is formed between the clamping part 82 and the first cover plate 3. Wherein the main body 1 is provided with a locating groove 15, the shaft foot 81 is arranged in the locating groove 15. Through the above structure, the structure is simple, the connection is stable, the installation of the card holder is effectively realized, and cards or change are able to put into the clamping space 821 by toggling the card holder. Also, the card holder is able to be clamped to a leather belt or a pocket through the clamping space 821.

In this embodiment, the card holder further includes a second connecting part 9, the upper sidewall 12 is provided with a fourth mounting hole 126, the second cover plate 7 is provided with a fifth mounting hole 71, the second connecting part 9 passes through the fifth mounting hole 71 and the fourth mounting hole 126 in sequence to detachably connect the second cover plate 7 with the upper sidewall 12. Wherein the first connecting part 5 and the second connecting part 9 are both flat head screws. Through the above structure, the structure is simple, the connection is stable, and the second cover plate 7 is able to be conveniently mounted and dismounted by the user. And since the first connecting part 5 and the second connecting part 9 are both flat head screws, the overall appearance of the card holder is smoother and more attractive.

Specifically, the main body 1 is a metal main body 1, the flexible protective cover 2 is a protective leather cover or a protective cloth cover, the first cover plate 3 is a first metal plate 3, the second cover plate 7 is a second metal plate 7, the clamping device 8 is a metal clamping device 8. Wherein the first sheet body 4, the second sheet body 41, the third sheet body 42 and the fourth sheet body 43 all are flexible sheet body.

The above descriptions are only preferred embodiments of the present disclosure, and are not intended to limit the patent scope of the present disclosure. Any equivalent structural transformation made by using the content of the specification and the drawings of the present disclosure under the invention idea of the present disclosure, directly or indirectly applied to other related technical fields, shall all be included in the scope of patent protection of the present disclosure.

What is claimed is:

1. A card holder, comprising a main body comprising a first containing cavity and a first containing opening, the first containing opening being communicated the first containing cavity, the first containing cavity is configured for holding the cards;

a flexible protective cover;

a first cover plate connected to the main body, wherein the flexible protective cover is arranged between the main body and the first cover plate, the first cover plate is connected to the main body via the flexible protective cover, wherein the flexible protective cover comprises a first part and a second part, the first part and the second part are rotatably connected, the first part is arranged between main body and the first cover plate, and the first cover plate is connected between the first part and the main body;

wherein main body comprises an upper sidewall, the upper sidewall comprises a first outer surface; and wherein the second part is able to rotate to cover the first outer surface of the upper sidewall, the second part is provided with a first magnetic attraction part, the upper sidewall is a metal upper sidewall, when the second part rotates to cover the first outer surface of the upper sidewall, the second part is attached to the upper sidewall by the first magnetic attraction part via magnetic force.

2. The card holder according to claim 1, wherein main body comprises a lower sidewall, the upper sidewall comprises a first inner surface, the lower sidewall comprises a second outer surface and a second inner surface, the first containing cavity is formed between first inner surface and the second inner surface, the first part is arranged between the second outer surface and the first cover plate, the first cover plate is connected with the second outer surface.

3. The card holder according to claim 1, wherein the flexible protective cover is further provided a second containing cavity and a second containing opening, the second containing opening is connected to the second containing cavity, and the second containing cavity is configured for holding paper currency.

4. The card holder according to claim 3, wherein the flexible protective cover comprises an inner layer and an outer layer, the inner layer is arranged between the first cover plate and the main body, the first cover plate is connected to the inner layer via the main body; the inner layer is connected with the outer layer, and the second containing cavity is formed between the inner layer and the outer layer.

5. The card holder according to claim 4, wherein the inner layer is provided a first bottom edge, a first top edge opposite to the first bottom edge, a first left edge connecting the first bottom edge to the first top edge and a first right edge; the outer layer is provided a second bottom edge, a second top edge opposite to the second bottom edge, a second left edge connecting the second bottom edge to the second top edge and a second right edge; the first bottom edge is connected with the second top edge, the first left edge is connected with the second left edge, the first right edge is connected with the second right edge, such that the inner layer is connected with the outer layer, the second containing cavity is formed between the inner layer and the outer layer, and the second containing opening is arranged between the first top edge and the second top edge.

6. A card holder, comprising a main body comprising a first containing cavity and a first containing opening, the first containing opening being communicated the first containing cavity, the first containing cavity is configured for holding the cards;

a flexible protective cover;

a first cover plate connected to the main body, wherein the flexible protective cover is arranged between the main body and the first cover plate, the first cover plate is connected to the main body via the flexible protective cover, wherein the flexible protective cover comprises a first part and a second part, the first part and the second part are rotatably connected, the first part is arranged between main body and the first cover plate, and the first cover plate is connected between the first part and the main body;

wherein a main part of the flexible protective cover further comprises a third part, the second part is rotatably connected with one side of the first part, the third part is rotatably connected with the other side of the first part, the third part is able to be rotated to cover the first part, and the second part is able to be rotated to cover the third part.

7. The card holder according to claim 6, wherein the third part is connected with the second part by magnetic force; the second part is provided with the first magnetic attraction part, the third part is provided with a first magnetic attraction matching part, when the third part rotates to cover the first part and the second part rotates to cover the third part, the first magnetic attraction part is connected with the first magnetic attraction matching part by magnetic force.

8. The card holder according to claim 6, wherein the flexible protective cover is further provided with the second containing cavity and the second containing opening, the second containing opening is connected with the second containing cavity, the second containing cavity is configured for holding paper currency, the second containing cavity extends between the first part, the second part and the third part, and the second containing opening extends between the first part, the second part and the third part.

9. The card holder according to claim 6, wherein the card holder further comprises a first sheet body, a second sheet body, a third sheet body and a fourth sheet body, the flexible protective cover comprises the inner layer and the outer layer, the inner layer is connected with the outer layer, the first sheet body is arranged on the second part and connected with an outer side of the outer layer, a third containing cavity is formed between the first sheet body and the outer side of the outer layer, a third containing opening is arranged on an upper side of the third containing cavity; the second sheet body is arranged on the second part and connected with an inner side of the outer layer, a fourth containing cavity is formed between the second sheet body and the inner side of the outer layer, a fourth containing opening is arranged on an upper side of the fourth containing cavity; the third sheet body is arranged on the first part and connected with the inner side of the outer layer, a fifth containing cavity is formed between the third sheet body and the inner side of the outer layer, a fifth containing opening is arranged on an upper side of the fifth containing cavity; the fourth sheet body is arranged on the third part and connected with the inner side of the outer layer, a sixth containing cavity is formed between the fourth sheet body and the inner side of the outer layer, and a sixth containing opening is arranged on an upper side of the sixth containing cavity.

10. The card holder according to claim 1, wherein the card holder further comprises a first connecting part, the main body is provided a first mounting hole, the flexible protective cover is provided a second mounting hole, the first cover plate is provided a third mounting hole, the first connecting part passes through the third mounting hole, the second mounting hole and the first mounting hole in sequence to detachably connect the first cover plate with the main body.

11. The card holder according to claim 2, wherein the card holder further comprises a first elastic band, the upper sidewall and the lower sidewall are connected by the first elastic band, the first elastic band tightens the upper sidewall to the lower sidewall, so that the first containing cavity for clamping the card is formed between the upper sidewall and the lower sidewall, wherein the first elastic band comprises a first band and a second band, the upper sidewall is provided a first side and a second side opposite to the first side, the lower sidewall is provided a third side and a fourth side opposite to the third side, wherein one end of the first band is provided a first rod connected the first band, the other end of the first band is provided a second rod connected the first band, the first side of the upper sidewall is provided a first fixing groove, the third side of the lower sidewall is provided a second fixing groove, two ends of the first rod are able to be fixed in two ends of the first fixing groove respectively such that the first rod is detachably connected to the first fixing groove, two ends of the second rod is able to be fixed in two ends of the second fixing grooves such that the second rod is detachably connected to the second fixing groove; one end of the second band is provided a third rod connected the second band, the other end of the second band is provided a fourth rod connected the second band, the second side of the upper sidewall is provided a third fixing groove, the fourth side of the lower sidewall is provided a fourth fixing groove, two ends of the third rod are able to be fixed in two ends of the third fixing groove respectively such that the third rod is detachably connected to the third fixing groove, and two ends of the fourth rod are able to be fixed in two ends of the fourth fixing groove respectively such that the fourth rod is detachably connected to the fourth fixing groove.

12. The card holder according to claim 11, wherein the card holder further comprises a second cover plate, the second cover plate is connected to the upper sidewall, the upper sidewall is provided a first groove, the lower sidewall is provided a second groove, one end of the first band is arranged into the first groove, the other end of the first band is arranged into the second groove; the first fixing groove and the third fixing groove are connected to the first groove, the second fixing groove and the fourth fixing groove are connected to the second groove; the first groove extends from the first side to the second side, and the second groove extends from the third side to the fourth side.

13. A card holder, comprising a main body comprising a first containing cavity and a first containing opening, the first containing opening being communicated the first containing cavity, the first containing cavity is configured for holding the cards;

a flexible protective cover;

a first cover plate connected to the main body, wherein the flexible protective cover is arranged between the main body and the first cover plate, the first cover plate is connected to the main body via the flexible protective cover, wherein the card holder further comprises an elastic clamping device, the clamping device is detachably connected to the main body; the clamping device is provided a shaft foot and a clamping part, the shaft foot is connected to the clamping part, the shaft foot is connected to the main body, the shaft foot is arranged between the main body and the flexible protective cover, the flexible protective cover covers on the shaft foot, the clamping part connects with the first cover plate, a clamping space is formed between the clamping part and the first cover plate.

14. The card holder according to claim 1, wherein a main part of the flexible protective cover further comprises a third part, the second part is rotatably connected with one side of the first part, the third part is rotatably connected with the other side of the first part, the third part is able to be rotated to cover the first part, and the second part is able to be rotated to cover the third part.

15. The card holder according to claim 1, wherein the card holder further comprises an elastic clamping device, the clamping device is detachably connected to the main body; the clamping device is provided a shaft foot and a clamping part, the shaft foot is connected to the clamping part, the shaft foot is connected to the main body, the shaft foot is arranged between the main body and the flexible protective cover, the flexible protective cover covers on the shaft foot, the clamping part compresses onto the first cover plate, a clamping space is formed between the clamping part and the first cover plate.

* * * * *